US009950438B2

(12) United States Patent
Kuroda et al.

(10) Patent No.: US 9,950,438 B2
(45) Date of Patent: Apr. 24, 2018

(54) SHEET PROCESSING APPARATUS AND METHOD FOR CONTROLLING SHEET PROCESSING APPARATUS

(71) Applicant: CANON KABUSHIKI KAISHA, Tokyo (JP)

(72) Inventors: Takashi Kuroda, Tokyo (JP); Tsuyoshi Muto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 736 days.

(21) Appl. No.: 14/512,190

(22) Filed: Oct. 10, 2014

(65) Prior Publication Data

US 2015/0105897 A1 Apr. 16, 2015

(30) Foreign Application Priority Data

Oct. 11, 2013 (JP) ..... 2013-213555
Oct. 11, 2013 (JP) ..... 2013-213556

(51) Int. Cl.
*B26F 1/04* (2006.01)
*B26D 5/20* (2006.01)

(52) U.S. Cl.
CPC ..... *B26D 5/20* (2013.01); *B26F 1/04* (2013.01); *Y10T 83/525* (2015.04); *Y10T 83/85* (2015.04)

(58) Field of Classification Search
None
See application file for complete search history.

(56) References Cited

U.S. PATENT DOCUMENTS 5,746,162 A * 5/1998 Hosoi ..... B65H 39/10 270/37
6,325,585 B1 * 12/2001 Sasaki ..... B26D 7/24 101/485
8,311,473 B2 * 11/2012 Sasaki ..... B26D 5/32 399/407
2006/0181750 A1 * 8/2006 Lu ..... H04N 1/00403 358/527
2008/0181699 A1 * 7/2008 Ueda ..... G03G 15/6582 399/408
2010/0090388 A1 * 4/2010 Toyoizumi ..... B65H 29/60 270/58.07
2010/0158597 A1 * 6/2010 Miyake ..... B26F 1/02 399/407

FOREIGN PATENT DOCUMENTS

JP 2001-316036 A 11/2001
JP 2003-226463 A 8/2003
JP 2008-195488 A 8/2008

* cited by examiner

*Primary Examiner* — Isaac T Tecklu

(74) *Attorney, Agent, or Firm* — Canon U.S.A., Inc. IP Division

(57) ABSTRACT

A sheet processing apparatus includes, a punch unit configured to perform punching processing on a sheet conveyed from one of a plurality of sheet storing units capable of storing a sheet or a pre-punched sheet, an input unit configured to input a number of holes punched in the pre-punched sheet stored in one of the sheet storing units, an acquisition unit configured to acquire a number of holes that can be punched by the punch unit, a determination unit configured to determine whether the input number of holes coincides with the acquired number of holes that can be punched, and a control unit configured to display a predetermined warning in a case where the determination unit determines that the input number of holes does not coincide with the acquired number of holes that can be punched.

14 Claims, 23 Drawing Sheets

SHEET PROCESSING APPARATUS AND METHOD FOR CONTROLLING SHEET PROCESSING APPARATUS

BACKGROUND OF THE INVENTION

Field of the Invention

The present invention relates to a sheet processing apparatus and a method for controlling a sheet processing apparatus.

Description of the Related Art

Conventionally, there has been a sheet processing apparatus that executes punching processing on a sheet on which an image is formed by an image forming apparatus. Such a sheet processing apparatus can punch a different number of holes in the sheet, e.g., two holes, three holes, or thirty holes.

On the other hand, pre-punched sheets, in which holes are pre-punched for filing, have been known.

Execution of punching processing on a pre-punched sheet enlarges pre-punched holes of the sheet to cause the position of the sheet to become unstable when the sheet is filed.

In order to solve this problem, there has been discussed a technique in which the number of punch holes of a pre-punched sheet is registered in advance as sheet information and no punching processing is executed if a sheet fed from a sheet feeding tray is determined to have pre-punched holes (refer to Japanese Patent Application Laid-Open No. 2001-316036).

This conventional technique can execute punching processing on a sheet other than a pre-punched sheet while executing no punching processing on a pre-punched sheet, and can then discharge the sheets to a single sheet discharging tray.

However, the user might set the number of holes to be punched by the punching processing that is different from the number of holes that are pre-punched in a pre-punched sheet. In this case, the number of punch holes punched in a sheet other than a pre-punched sheet is not the same as the number of holes punched in a pre-punched sheet. Thus, the positions of the holes in the sheet other than the pre-punched sheet do not coincide with the positions of the holes in the pre-punched sheet. As a result, a hole of a sheet is covered with another sheet when the sheets are bundled. Therefore, it is impossible to file the sheets.

SUMMARY OF THE INVENTION

According to an aspect of the present invention, a sheet processing apparatus includes, a punch unit configured to perform punching processing on a sheet conveyed from one of a plurality of storing units capable of storing a sheet or a pre-punched sheet, an input unit configured to input a number of holes punched in a pre-punched sheet stored in one of the storing units, an acquisition unit configured to acquire a number of holes that can be punched by the punch unit, a determination unit configured to determine whether an input number of holes corresponds to an acquired number of holes that can be punched, and a control unit configured to display a predetermined warning in a case where the determination unit determines that the input number of holes does not correspond to the acquired number of holes that can be punched.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

<Description of System Configuration>

Figure 1:
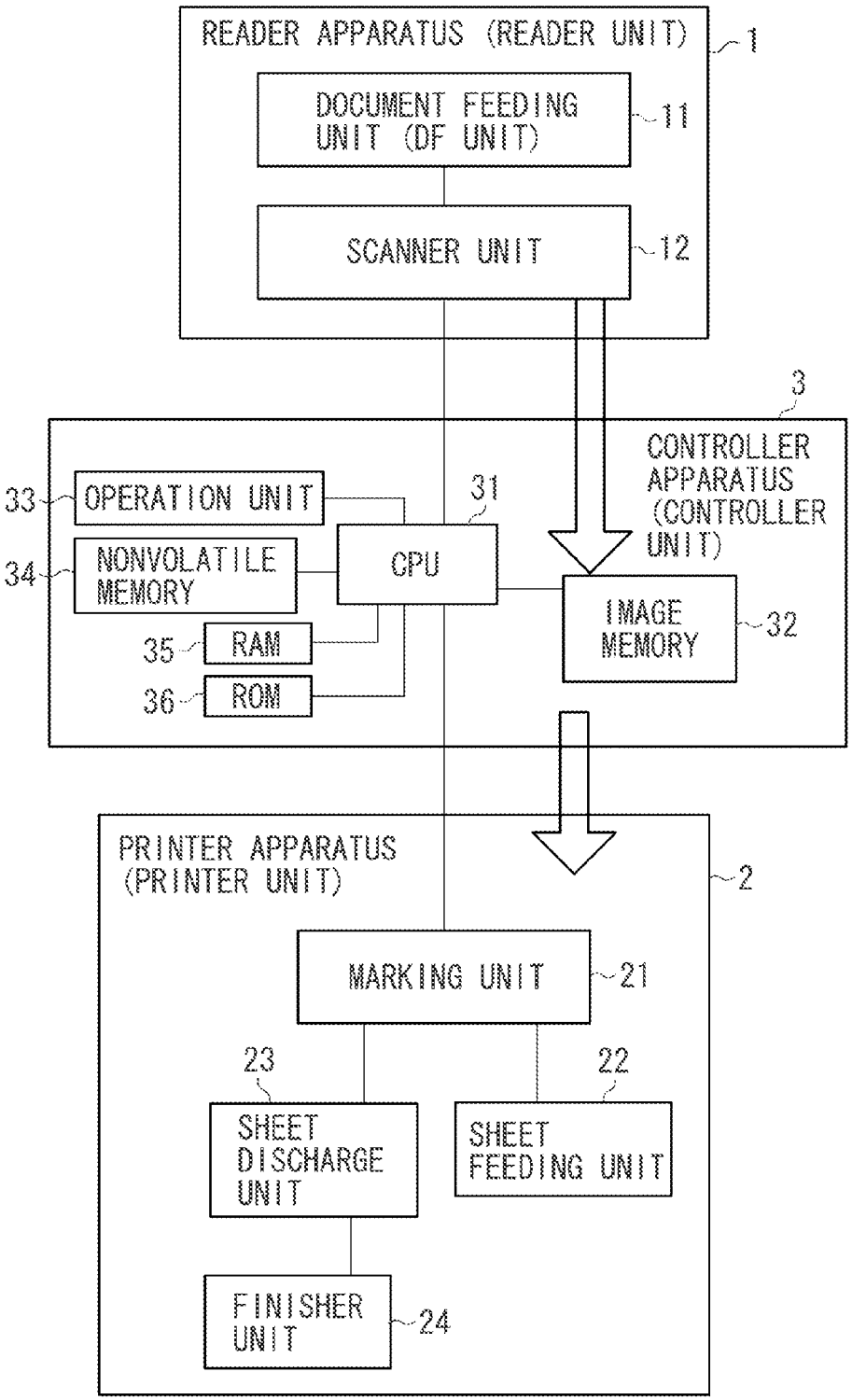
FIG. 1 is a block diagram illustrating a configuration of an image forming apparatus to which a sheet post-processing apparatus is applicable.

FIG. 1 is a block diagram illustrating a configuration of an image forming apparatus to which a sheet post-processing apparatus according to a first exemplary embodiment of the present invention is applicable.

In FIG. 1, a reader unit (image input apparatus) 1 optically reads a document image and converts the read document image into image data. The reader unit 1 includes a scanner unit 12 and a document feeding unit (DF unit) 11. The scanner unit 12 has a function of reading a document. The DF unit 11 has a function of conveying document sheets.

A printer unit (image output apparatus) 2 conveys a sheet (paper or recording sheet), prints image data as a visible image on the sheet, and discharges the sheet to the outside of the apparatus. The printer unit 2 includes a sheet feeding unit 22 and a marking unit 21. The sheet feeding unit 22 includes a plurality of types of sheet storing cassettes. The marking unit 21 has a function of transferring and fixing the image data onto the sheet. The printer unit 2 further includes a sheet discharge unit 23 and a finisher unit 24. The sheet discharge unit 23 has a function of outputting the printed sheet to the outside of the apparatus. The finisher unit 24 executes punching processing and sorting processing. A controller apparatus includes a central processing unit (CPU) 31, an image memory 32, a nonvolatile memory 34, a random-access memory (RAM) 35, a read-only memory (ROM) 36, and an operation unit 33.

The controller apparatus 3 is electrically connected to the reader unit 1 and the printer unit 2. The CPU 31 in the controller apparatus 3 controls the reader unit 1 to read image data of an original document into the image memory 32 and controls the printer unit 2 to output the image data stored in the image memory 32 onto a sheet, thereby providing a copy function. The nonvolatile memory 34 stores various types of adjustment values. The RAM 35 is used as a work area of the CPU 31. The ROM 36 stores control programs of the CPU 31.

The operation unit 33 includes a liquid crystal display (LCD) unit, a touch panel input device attached to the LCD unit, and a plurality of hard keys. A signal input through the touch panel or the hard keys is sent to the CPU 31, and the LCD unit displays operational functions of the image forming apparatus, image data, and the like.

Figure 2:
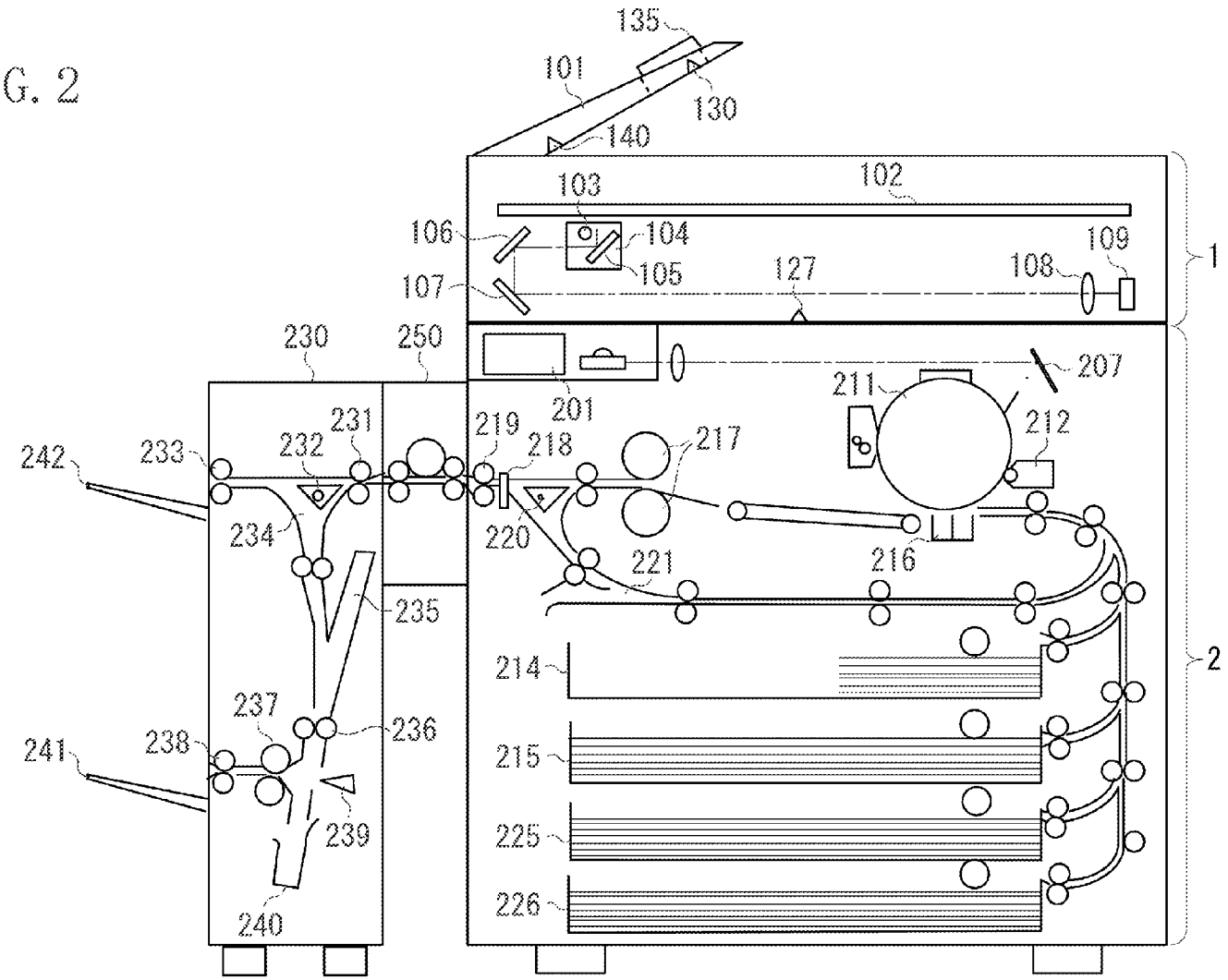
FIG. 2 is a configuration diagram illustrating an inner configuration of the image forming apparatus illustrated in FIG. 1.

FIG. 2 is a configuration diagram illustrating an inner configuration of the image forming apparatus (copy machine) illustrated in FIG. 1.

The image forming apparatus according to the present exemplary embodiment includes the reader unit 1, the printer unit 2, a sorter 230, and a punch unit 250. The punch unit 250 performs punching processing on a sheet fed from one of the sheet feeding units. The number of punch holes can be selected from two holes, three holes, and four holes. The punch unit 250 may be configured so as to be able to punch the number of holes other than two, three, and four. Further, the number of holes to be punched in a sheet fed from the plurality of sheet stacking units included in the sheet feeding unit 22 is settable as described below.

In FIG. 2, the reader unit 1 includes a document feeding device 101, a platen glass surface 102, a lamp 103, a scanner unit 104 including a mirror 105, mirrors 106 and 107, a lens 108, and a charge-coupled device (CCD) image sensor unit (hereinafter, abbreviated as "CCD") 109.

The printer unit 2 includes an exposure control unit 201, a polygon mirror 207, a photosensitive member 211, a development unit 212, a transfer unit 216, a fixing unit 217, a sheet discharge unit 218, discharge rollers 219, and a conveyance direction switching member 220. The printer unit 2 further includes a refeeding sheet stacking unit 221 and sheet stacking units 214, 215, 225, and 226.

Documents loaded in the document feeding device 101 are sequentially conveyed one by one onto the platen glass surface 102. When an original document is conveyed to a predetermined position on the glass surface 102, the lamp 103 of the scanner unit 104 is turned on, and the scanner unit 104 is moved to illuminate the document. Reflection light from the document is input to the CCD 109 via the mirrors 105, 106, and 107, and the lens 108. Details of the printer unit 2 will be described below.

The sorter 230 includes inlet rollers 231, a conveyance path switching member 232, sheet discharge rollers 233, and a vertical conveyance path 234. The sorter 230 further includes a saddle stacker 235, saddle positioning rollers 236, saddle abutting rollers 237, a saddle abutting member 239, a saddle positioning member 240, bins 241 and 242, and the like.

The configuration and operation of the printer unit 2 will be described below with reference to FIG. 2.

An image signal input to the printer unit 2 is converted into an optical signal modulated by the exposure control unit 201 to illuminate the photosensitive member 211 with the modulated optical signal. A latent image formed on the photosensitive member 211 by the illumination light is developed by the development unit 212. At the same timing of a leading end of the developed image, a sheet is conveyed from the sheet stacking unit (feed port) 214 or the sheet stacking unit 215, and the transfer unit 216 transfers the developed image onto the sheet. In the present exemplary embodiment, the sheet stacking units store pre-punched sheets (tab sheets) and sheets that are to be punched by the punch unit 250. The term "pre-punched paper" refers to a pre-punched sheet.

The transferred image is then fixed to the sheet by the fixing unit 217. Thereafter, the sheet is discharged to the outside of the apparatus by the sheet discharge unit 218.

The sheet discharged from the sheet discharge unit 218 is conveyed to the punch unit 250, punched by the punch unit 250 in a case where a punching function is activated, and then sent to the sorter 230. The punch unit 205 includes needles for punching two holes in one sheet and also includes needles for punching three holes in one sheet, and the sheet conveyed to the punch unit 250 is punched with the needles corresponding to the set number. The punch unit 250 is removable from and attachable to the image forming apparatus so that the punch unit 250 can be replaced by a punch unit for punching a different number of holes. For example, the punch unit 250 can be replaced by a punch unit that includes needles for punching four holes. The sorter 230 discharges the sheets to the respective bins in a case where a sorting function is activated, or the sorter 230 discharges the sheets to the uppermost bin in a case where the sorting function is deactivated.

Next, a method for outputting sequentially-read images to both surfaces of one sheet will be described. After a sheet on which an image is fixed by the fixing unit 217 is conveyed to the sheet discharge unit 218 once, the conveyance direction of the sheet is reversed to convey the sheet to the refeeding sheet stacking unit 221 via the conveyance direction switching member 220. When a subsequent document is prepared, an image of the document is read through the processing described above while the sheet is fed from the refeeding sheet stacking unit 221, whereby the two-page document images can respectively be output to front and rear surfaces of the single sheet.

Figure 3:
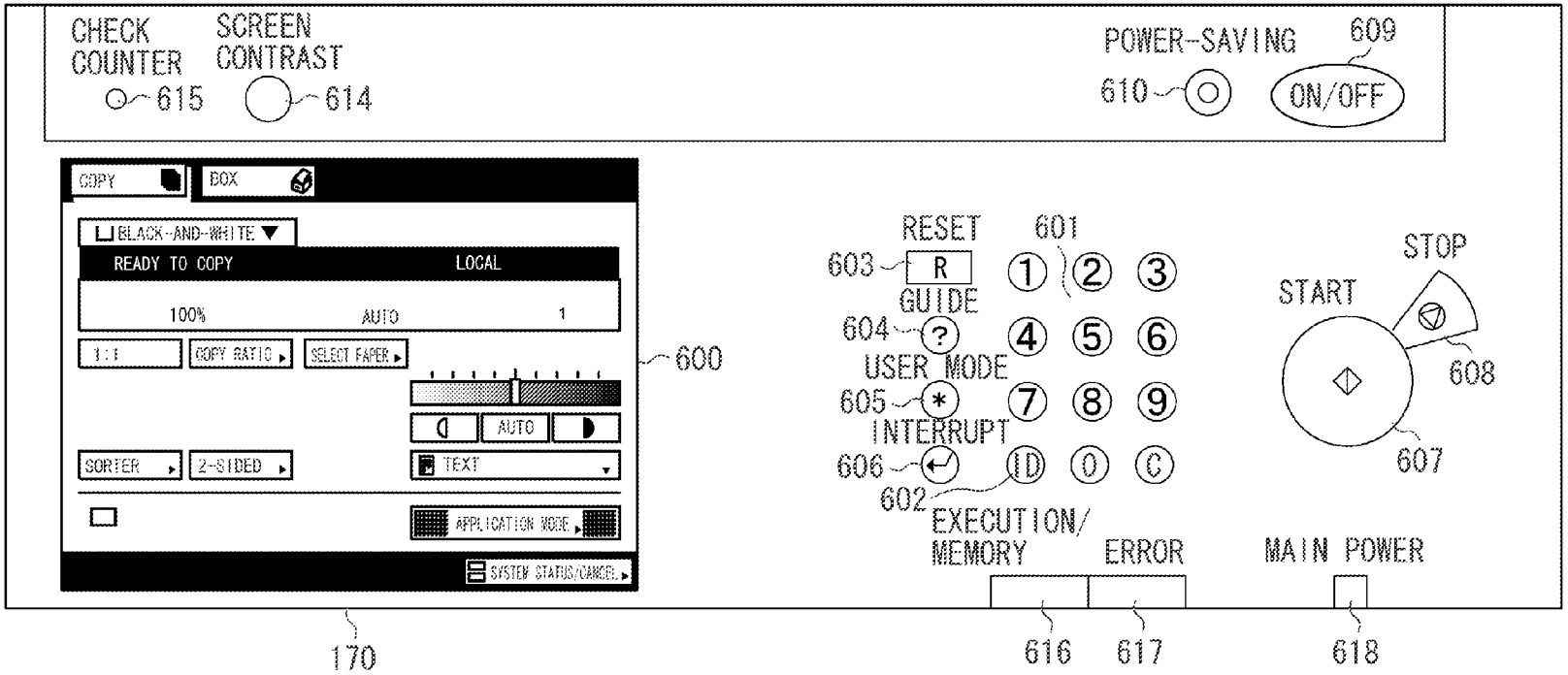
FIG. 3 is a plan view illustrating a configuration of an operation unit illustrated in FIG. 1.

FIG. 3 is a plan view illustrating a configuration of the operation unit 33 illustrated in FIG. 1.

In FIG. 3, an LCD touch panel 600 is used for major mode settings and displaying a status. Ten keys 601 are for inputting numerical values of 0 to 9. An identification (ID) key 602 is used to input a department number and a security mode in a case where the apparatus is departmentally managed.

A reset key 603 is for resetting a set mode. A guide key 604 is for displaying a mode description screen. An interrupt key 606 is for executing an interruption copy. A start key 607 is for starting a copy operation. A stop key 608 is for stopping a copy job that is in progress. A user mode key 605 is for entering a user mode screen. The user presses the user mode key 605 to set a sheet type described below.

When a soft power switch SW 609 is pressed, the backlight of the LCD 600 is turned off, and the apparatus is shifted to a low-power state. When a power-saving key 610 is pressed, the apparatus is shifted to a power-saving state. When the power-saving key 610 is pressed again, the apparatus recovers from the power-saving state.

An adjustment key 614 is for adjusting the contrast of the LCD touch panel. When a counter check key 615 is pressed, the LCD displays a count screen showing the total number of copies used up to the point.

A light emitting diode (LED) 616 indicates that images are accumulated in the image memory 32 during the execution of a job. An error LED 617 indicates that the apparatus is in an error state, e.g., jam, door opened, and the like. A power switch LED 618 indicates that a main switch of the apparatus is on.

A method for setting sheet information will be described with reference to FIGS. 4 to 8. Contents of the settings set via the screens illustrated in FIGS. 4 to 8 are stored in the nonvolatile memory 34.

FIGS. 4 to 8 each illustrate an example of a UI screen displayed on the operation unit 33 illustrated in FIG. 1. In the present exemplary embodiment, a feed port 1 stores B4 size sheets, and feed ports 2, 3, and 4 each store A4 size sheets. The feed ports 1, 2, 3, and 4 correspond to the sheet stacking units 214, 215, 225, and 226, respectively.

Figure 4:
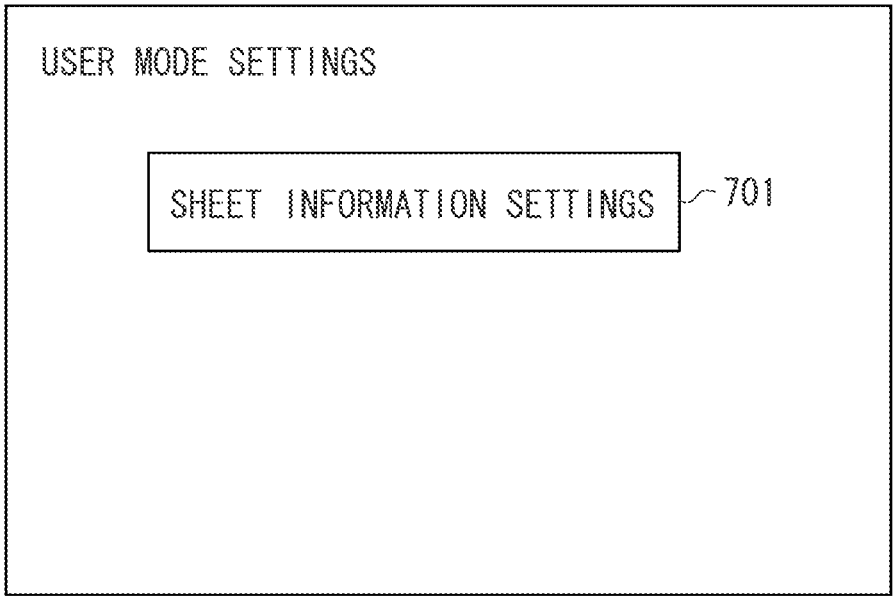
FIG. 4 illustrates an example of a user interface (UI) screen displayed on the operation unit illustrated in FIG. 1.

If the user presses the user mode key 605 of the operation unit 33, the LCD 600 included in the operation unit 33 displays a user mode setting screen illustrated in FIG. 4. A key 701 is a key for setting sheet information. If the user presses the key 701, the LCD 600 displays a sheet information setting screen 702 illustrated in FIG. 5.

Figure 5:
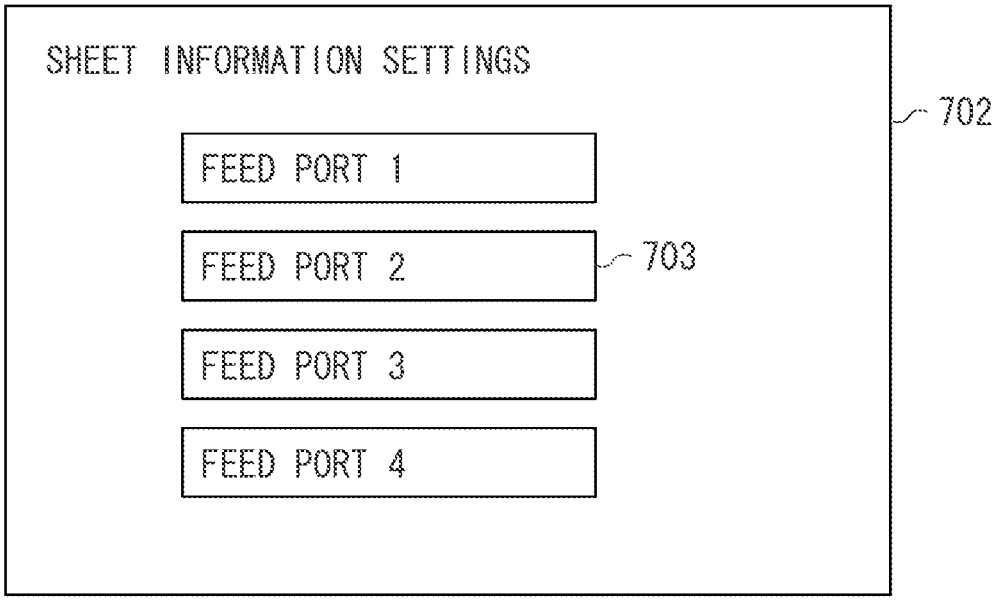
FIG. 5 illustrates an example of a UI screen displayed on the operation unit illustrated in FIG. 1.

The sheet information setting screen 702 illustrated in FIG. 5 includes keys 703 for the feed ports 1 to 4. When a key 703 is pressed, the LCD 600 displays a sheet information details/change screen 704 illustrated in FIG. 6, and the user can set a sheet type for each feed port.

Figure 6:
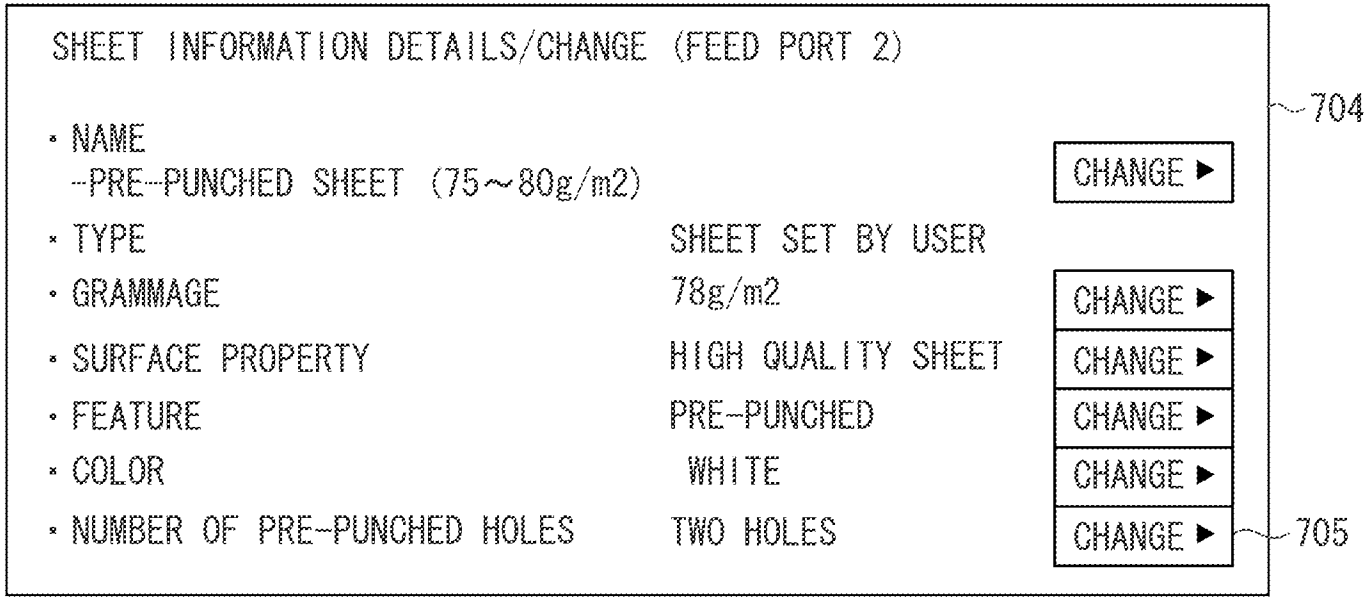
FIG. 6 illustrates an example of a UI screen displayed on the operation unit illustrated in FIG. 1.

The user operates the operation screens illustrated in FIGS. 5 and 6 in advance to set sheet information for each feed port so that the image forming apparatus can acquire the sheet information to determine the sheet type for each feed port.

The sheet information details/change screen 704 illustrated in FIG. 6 displays information about the name, type, grammage, surface property, feature, color, and the number of punch holes of the sheet. The user can change a set value of the name, grammage, surface property, feature, color, or the number of punch holes of the sheet by pressing a changing button 705.

Figure 7:
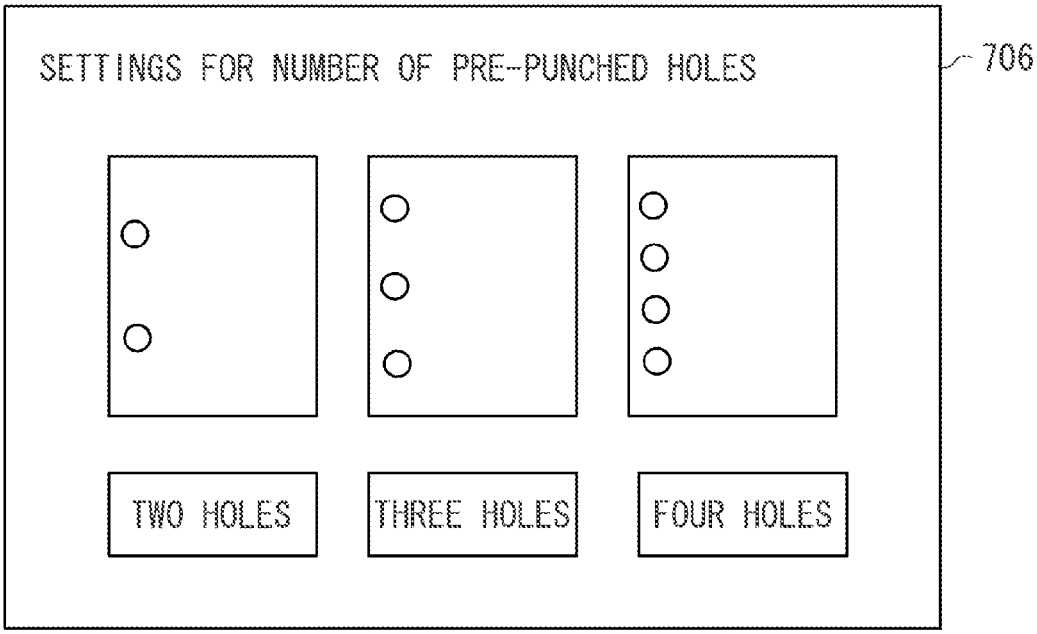
FIG. 7 illustrates an example of a UI screen displayed on the operation unit illustrated in FIG. 1.

When the changing button 705 for changing the number of punch holes is pressed, the LCD 600 displays a screen 706 illustrated in FIG. 7 for setting the number of pre-punched holes.

The screen 706 for setting the number of pre-punched holes displays selection keys for selecting the number of punch holes from two punch holes, three punch holes, and four punch holes and also displays images of pre-punched sheets with two, three, and four holes.

Figure 8:
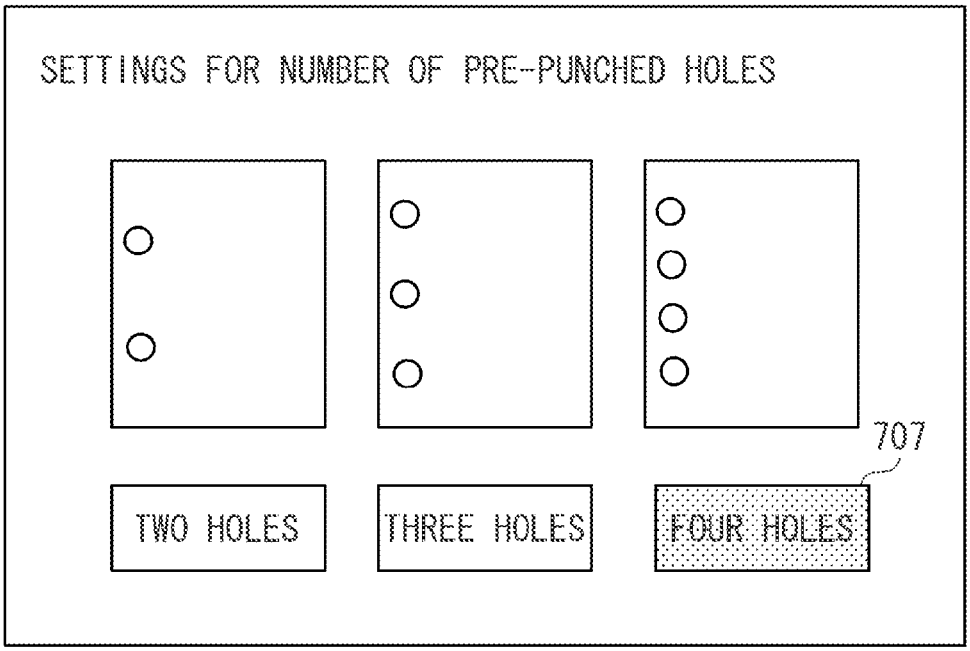
FIG. 8 illustrates an example of a UI screen displayed on the operation unit illustrated in FIG. 1.

When a selection key 707 for selecting the number of punch holes is pressed, the sheet information "pre-punched sheet with four holes" is set to the corresponding feed port, and the selection key 707 for selecting the number of punch holes is highlighted as illustrated in FIG. 8. In the present exemplary embodiment, together with the information about the name, type, grammage, and the like of a sheet, the number of holes punched in the sheet is also registered as the information about sheet stored in each feed port of the sheet feeding unit 22.

A method for selecting a feed port in a case where a tab sheet insertion function in copying is used, will be described with reference to FIGS. 9 to 13A and 13B. Details of a warning screen illustrated in FIG. 19 will be described below.

FIGS. 9 to 13A and 13B each illustrate an example of the UI screen displayed on the operation unit 33 illustrated in FIG. 1.

Figure 9:
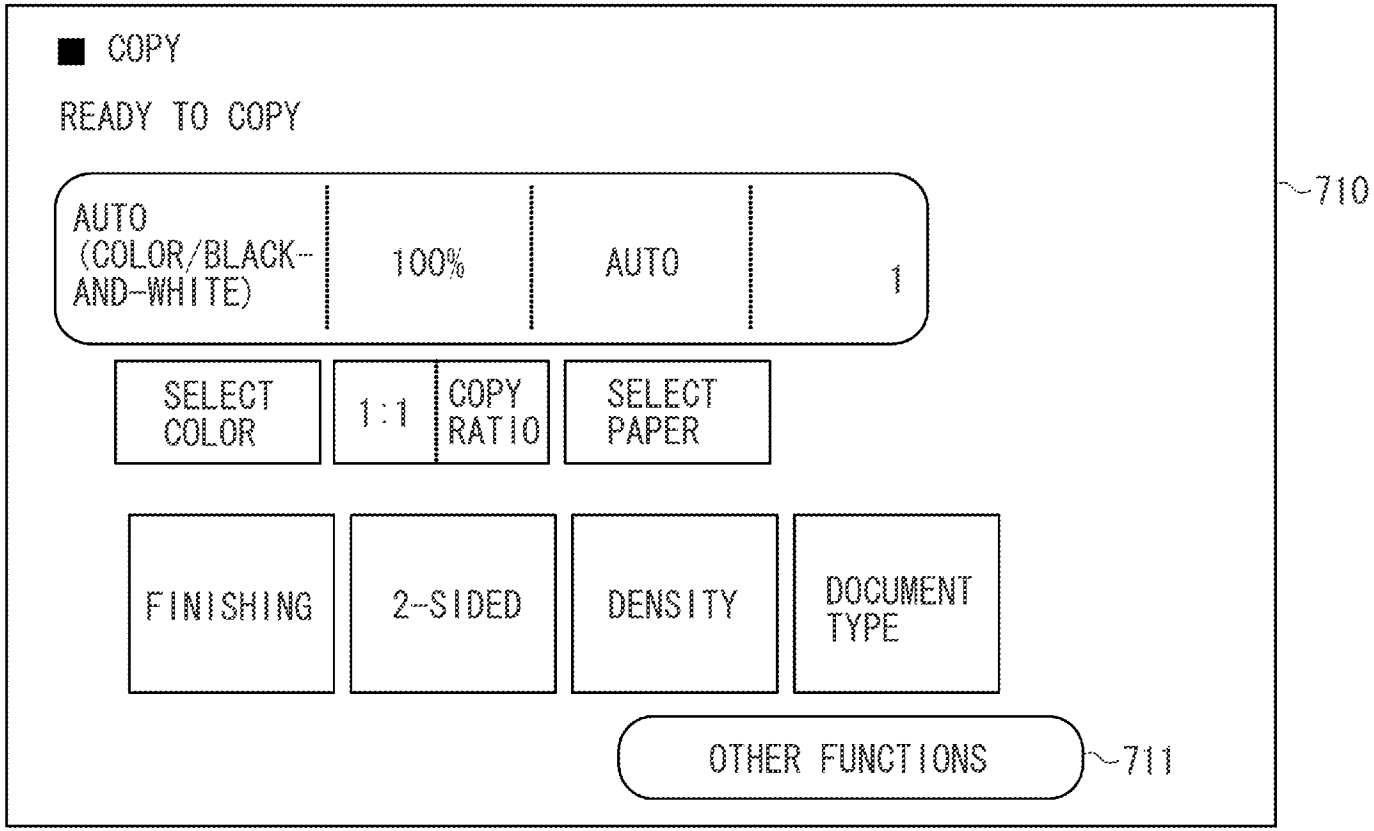
FIG. 9 illustrates an example of a UI screen displayed on the operation unit illustrated in FIG. 1.

The UI screen illustrated in FIG. 9 is a copy setting screen displayed on the LCD 600.

Figure 10:
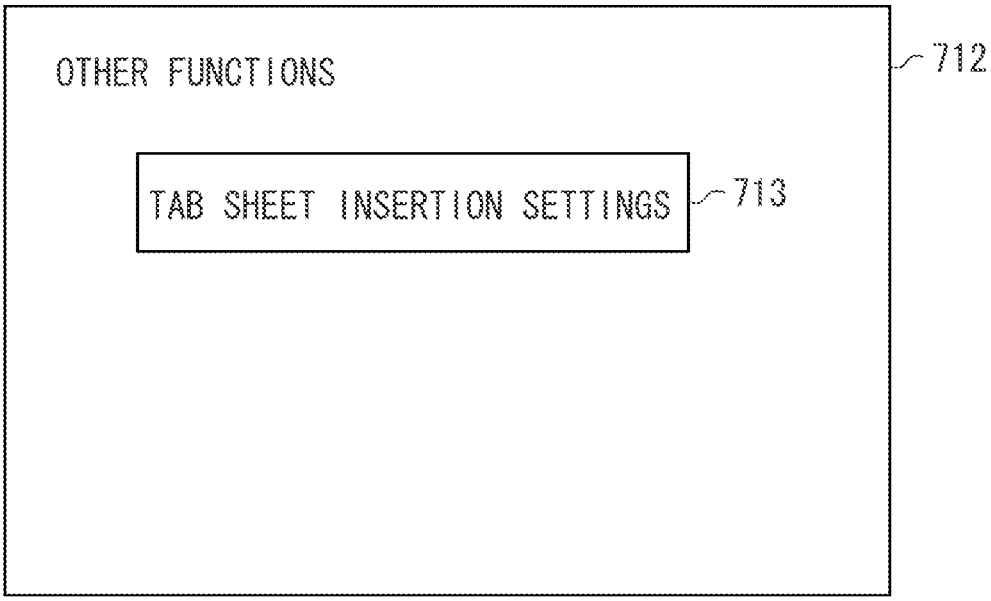
FIG. 10 illustrates an example of a UI screen displayed on the operation unit illustrated in FIG. 1.

On the copy setting screen 710 illustrated in FIG. 9, if the user presses an other functions key 711, the LCD 600 displays an other functions screen 712 illustrated in FIG. 10.

Figure 11:
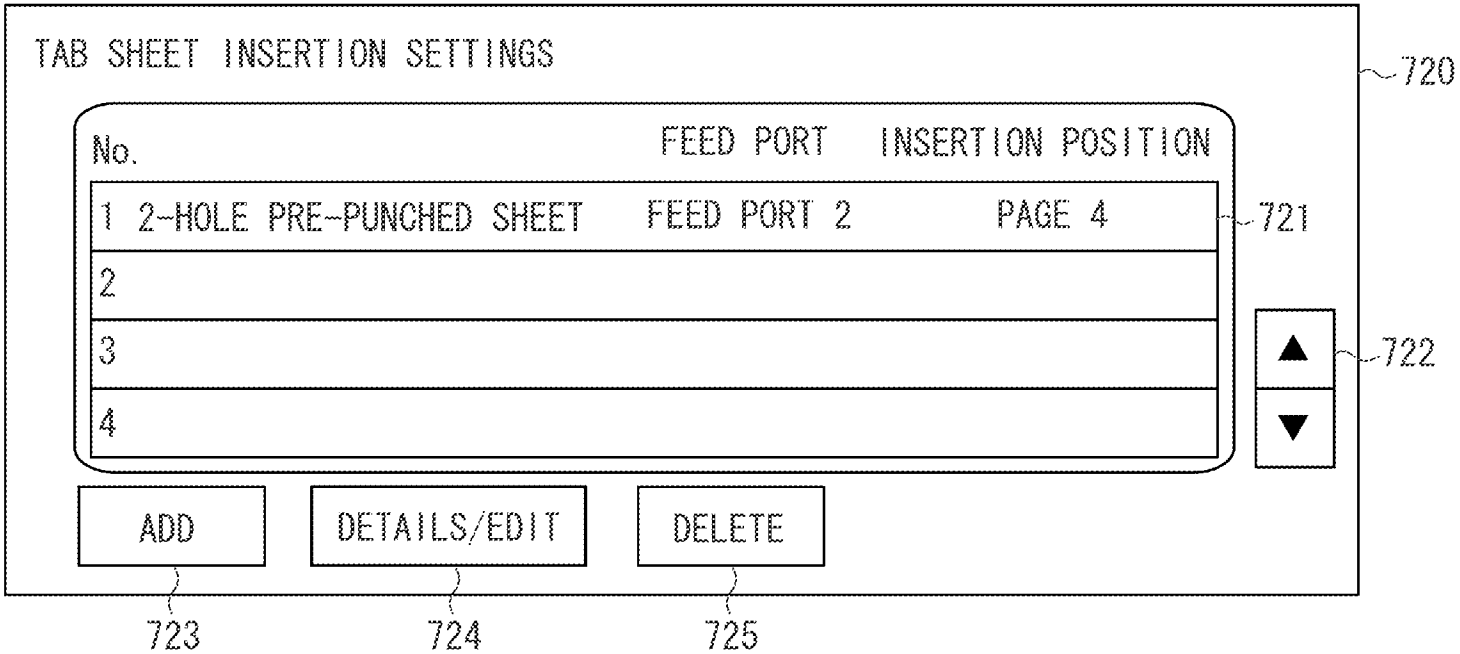
FIG. 11 illustrates an example of a UI screen displayed on the operation unit illustrated in FIG. 1.

On the other functions screen 712 illustrated in FIG. 10, if the user presses a tab sheet insertion setting key 713, the LCD 600 displays a tab sheet insertion setting screen 720 illustrated in FIG. 11.

On the tab sheet insertion setting screen 720 illustrated in FIG. 11, a tab sheet insertion list 721 shows a list of tab sheet insertion settings set by the user. A scroll key 722 is for scrolling the tab sheet insertion list 721 upward or downward.

The tab sheet insertion setting screen 720 also displays a tab sheet insertion setting addition key 723, a tab sheet insertion setting details/edit key 724, and a tab sheet insertion setting deletion key 725.

Figure 12:
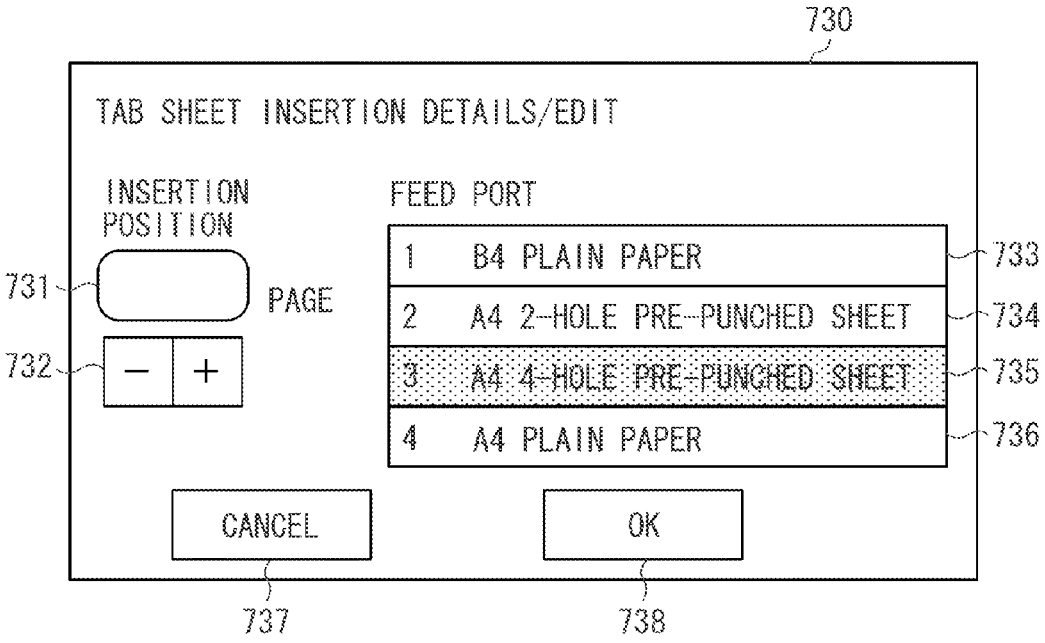
FIG. 12 illustrates an example of a UI screen displayed on the operation unit illustrated in FIG. 1.

When the tab sheet insertion setting addition key 723 is pressed, the LCD 600 displays a tab sheet insertion details/edit screen 730 illustrated in FIG. 12.

On the tab sheet insertion details/edit screen 730 illustrated in FIG. 12, when an insertion position page setting key 732 is pressed, the insertion position page number displayed on an insertion position display section 731 increases or decreases. On the tab sheet insertion details/edit screen 730, feed port selection keys 733 to 736 are for selecting a feed port as a conveyance source of a tab sheet to be inserted.

When an OK key 738 is pressed after inputting the insertion position and selecting the feed port, the tab sheet insertion details/edit screen 730 is closed to return to the tab sheet insertion setting screen 720, and the tab sheet insertion setting is added to the tab sheet insertion list 721.

On the tab sheet insertion setting screen 720 illustrated in FIG. 11, when the tab sheet insertion setting details/edit key 724 is pressed, the LCD 600 displays the tab sheet insertion details/edit screen 730 to display details of the tab sheet insertion setting selected in the tab sheet insertion list 721.

On the tab sheet insertion setting screen 720 illustrated in FIG. 11, when the tab sheet insertion setting deletion key 725 is pressed, the tab sheet insertion setting selected in the tab sheet insertion list 721 is deleted. In a case where the number of punch holes that can be punched by the punch unit 250 connected to the image forming apparatus is either two holes or three holes, the feed port 3 in which the pre-punched sheet with four holes is stored as the sheet information is not in a selectable state, as illustrated in FIG. 12. In the example illustrated in FIG. 12, the key for selecting the feed port 3 is grayed out.

Figure 13A:
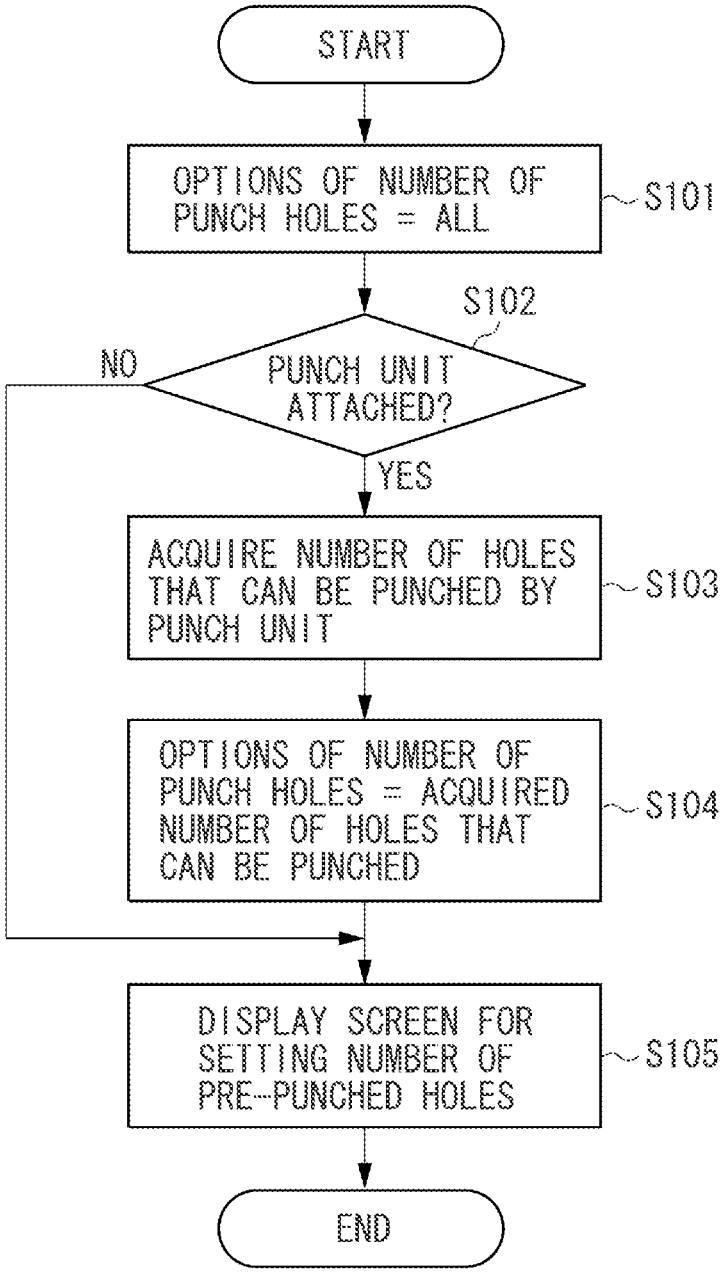
FIGS. 13A and 13B are flow charts each illustrating a method for controlling a sheet processing apparatus.
Figure 13B:
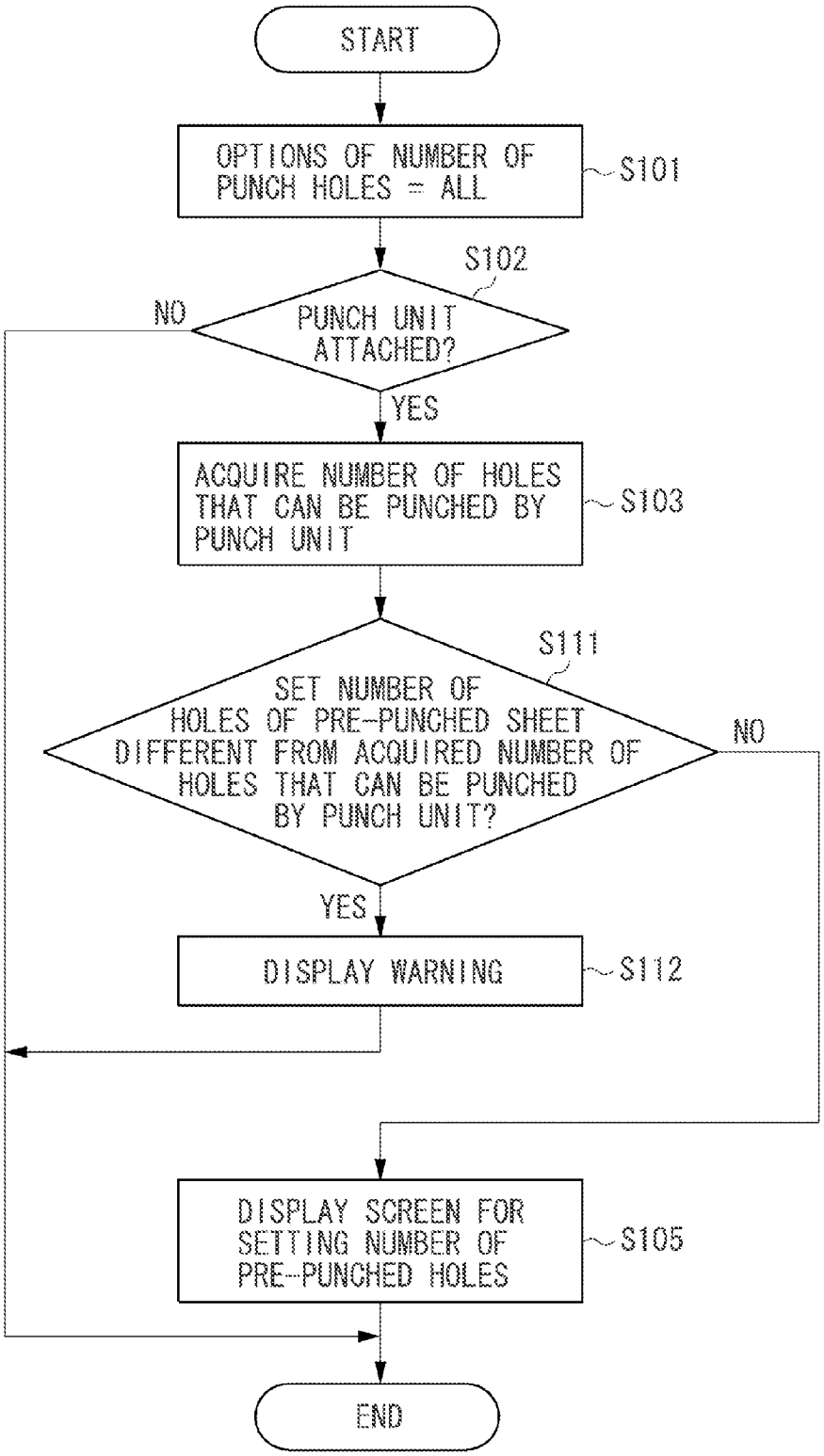

FIGS. 13A and 13B are flow charts each illustrating a method for controlling a sheet processing apparatus according to the present exemplary embodiment. This is a control example in which the selection keys for selecting the number of punch holes that are displayed on the setting screen 706 are controlled in such a manner that a pre-punched sheet cannot be registered at the time of setting the sheet information if the number of holes in the pre-punched sheet is not an option of the number of punch holes that can be punched by the punch unit 250 connected to the image forming apparatus. The CPU 31 executes a control program stored in the ROM 36 or the like to realize each step. FIG. 13A illustrates a control example in which when sheet processing using a pre-punched sheet is executed, the number of holes that can be input is limited based on an acquired number of holes. FIG. 13B illustrates a control example in which whether the number of holes that is selected by the user corresponds to the acquired number of holes that can be punched is determined, and if it is determined that the numbers do not coincide with each other, a predetermined warning is displayed. In the present exemplary embodiment, a message indicating that the positions of holes in a pre-punched sheet do not coincide with the positions of holes to be punched in the pre-punched sheet is displayed as the predetermined warning. Alternatively, the predetermined warning may be displayed as a graphic indicating that the positions of holes in a pre-punched sheet do not coincide with the positions of holes to be punched in the pre-punched sheet. Alternatively, the predetermined warning may be displayed as a combination of the graphic and the message.

In step S101, if the user presses the changing button 705 for changing the number of punch holes on the sheet information details/change screen 704 displayed on the LCD 600, the CPU 31 includes all of the numbers of holes (in the present exemplary embodiment, two holes, three holes, and four holes) in the options of the number of punch holes.

In step S102, the CPU 31 refers to finisher configuration information acquired in advance from the finisher unit 24 at the time of activation, and determines whether the punch unit 250 is attached to the finisher unit 24.

If the CPU 31 determines that the punch unit 250 is not attached to the finisher unit 24 (NO in step S102), then in step S105, the CPU 31 activates the selection keys for selecting the number of punch holes that are included in the options of the number of punch holes, and the CPU 31 displays the screen 706 for setting the number of pre-punched holes.

In this case, since all of the numbers of holes (two holes, three holes, four holes) are set in step S101 as the options of the number of punch holes, the selection keys for all of the numbers of punch holes are activated. This is because when the punch unit 250 is not connected, no punching is to be performed on a sheet other than a pre-punched sheet and, thus, misalignment of holes does not occur. In the case where the punch unit 250 is not connected, all of the selection keys for selecting the number of punch holes may be deactivated.

On the other hand, if the CPU 31 determines that the punch unit 250 is attached to the finisher unit 24 (YES in step S102), then in step S103, the CPU 31 acquires from the finisher configuration information the number of holes that can be punched by the punch unit 250. In step S104, the CPU 31 includes the number of holes that can be punched in the options of the number of punch holes.

If the number of holes that can be punched by the punch unit 250 is two or three holes, the options of the number of punch holes are two holes and three holes.

In step S105, the CPU 31 activates each selection key for selecting the number of punch holes that is included in the options of the number of punch holes, and the CPU 31 displays the screen 706 for setting the number of pre-punched holes and then ends the processing.

Another processing illustrated in FIG. 13B will be described below. Here, only differences from FIG. 13A will be described. This is a processing example in which whether the selected number of holes coincide with the number of holes that can be punched by the punch unit 250 is determined, and if it is determined that the input number of holes does not coincide with the acquired number of holes that can be punched, a predetermined warning is displayed.

In step S111, the CPU 31 determines whether the number of holes that is set to a pre-punched sheet is different from the number of holes that can be punched by the punch unit 250. If the CPU 31 determines that the number of holes that is set to a pre-punched sheet is different from the number of holes that can be punched by the punch unit 250 (YES in step S111), then in step S112, the CPU 31 displays a predetermined warning on the LCD 600 and ends the processing.

According to the present exemplary embodiment, in the case where sheet processing using a pre-punched sheet is performed, the number of holes that can be input with respect to a pre-punched sheet can be limited based on the acquired number of holes that can be punched by the punch unit 250. This can prevent the problem that when a pre-punched sheet and a sheet other than a pre-punched sheet are discharged together, the sheets cannot be filed due to a difference in positions of the holes in the sheets.

Figure 14:
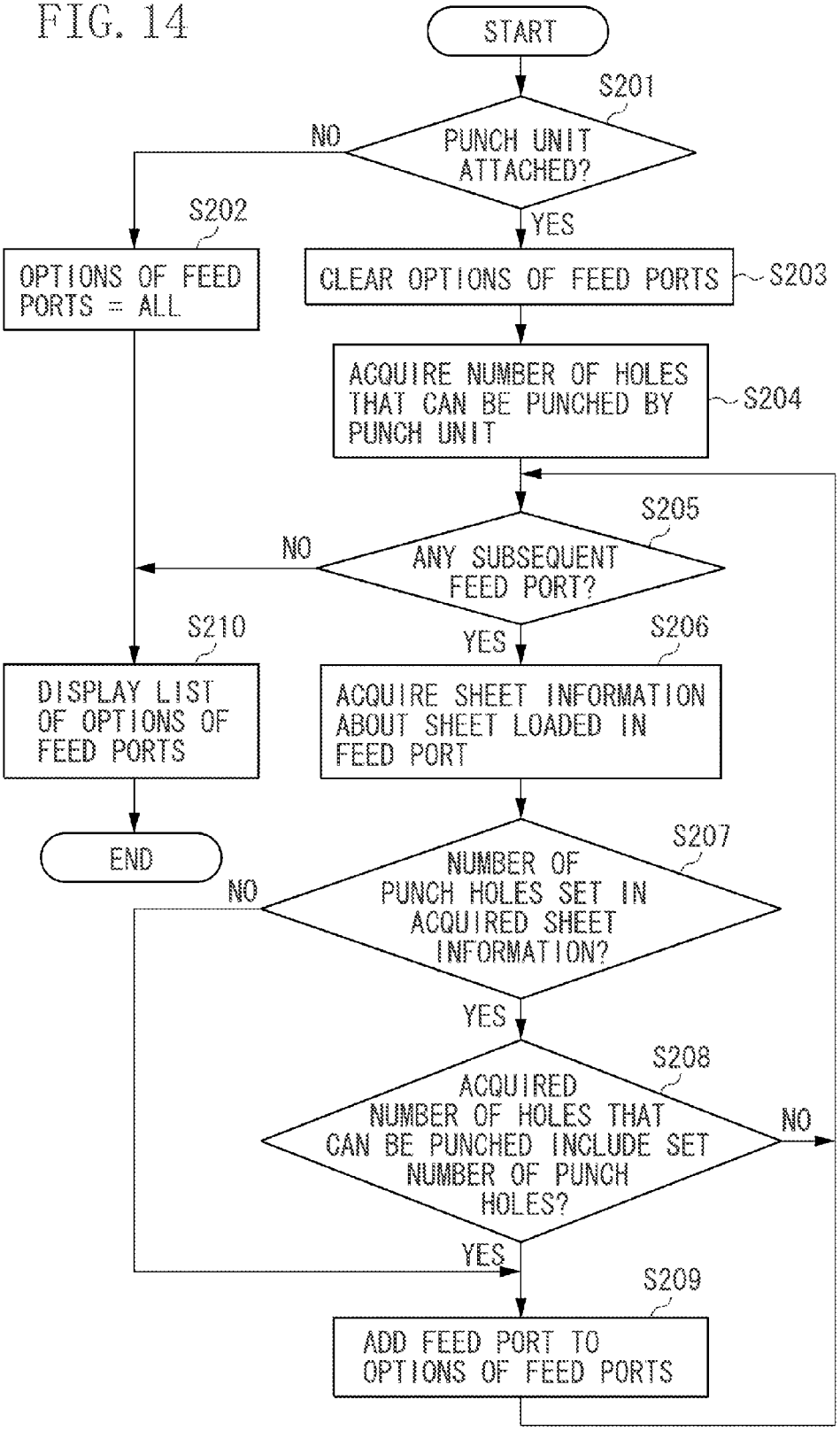
FIG. 14 is a flow chart illustrating a method for controlling a sheet processing apparatus.

FIG. 14 is a flow chart illustrating a method for controlling a sheet processing apparatus according to a second exemplary embodiment. This is an example in which at the time of setting tab sheet insertion during copying, the feed port selection keys displayed on the tab sheet insertion details/edit screen 730 are controlled. The CPU 31 executes a control program stored in the ROM 36 or the like to realize each step. The processing in which when sheet processing using a pre-punched sheet is performed, a sheet feeding unit to feed a sheet is selected based on the acquired number of holes and the set number of holes. The sheet feeding unit corresponds to the sheet stacking unit illustrated in FIG. 2.

In step S201, if the user presses the tab sheet insertion setting addition key 723 on the tab sheet insertion setting screen 720, the CPU 31 refers to the finisher configuration information and determines whether the punch unit 250 is attached to the finisher unit 24.

If the CPU 31 determines that the punch unit 250 is not attached to the finisher unit 24 (NO in step S201), then in step S202, the CPU 31 sets every one of the feed ports as a feed port option. Then, in step S210, the CPU 31 activates each selection key for the feed port set as a feed port option, displays a feed port selection list, and then ends the processing.

On the other hand, if the CPU 31 determines that the punch unit 250 is attached to the finisher unit 24 (YES in step S201), then in step S203, the CPU 31 clears the feed port options. In step S204, the CPU 31 acquires from the finisher configuration information the number of holes that can be punched by the punch unit 250.

In step S205, the CPU 31 determines for every feed port whether there is a subsequent feed port in order to execute the following processing. If the CPU 31 determines that there is no subsequent feed port (NO in step S205), the processing proceeds to step S210. If the CPU 31 determines that there is a subsequent feed port (YES in step S205), the processing proceeds to step S206.

In step S206, the CPU 31 acquires sheet information about a sheet loaded in the feed port. In step S207, the CPU 31 determines whether the number of punch holes is set in the acquired sheet information. If the CPU 31 determines that the number of punch holes is set in the acquired sheet information (YES in step S207), then in step S208, the CPU 31 determines whether the set number of punch holes is included in the acquired number of punch holes that can be punched that is acquired in step S204. If the CPU 31 determines that the set number of punch holes is included in the acquired number of punch holes that can be punched and that is acquired in step S204 (YES in step S208), then in step S209, the CPU 31 adds the feed port to the feed port options, and then the processing returns to step S205.

On the other hand, in step S207, if the CPU 31 determines that the number of punch holes is not set in the acquired sheet information (NO in step S207), then in step S209, the CPU 31 adds the feed port to the feed port options.

Then, in step S205, if the CPU 31 determines that the foregoing processing is completed for every one of the feed ports, then in step S210, the CPU 31 activates the selection keys for the feed ports set as the feed port options, displays the feed port selection list, and ends the processing.

According to the present exemplary embodiment, in the case where the sheet processing using a pre-punched sheet is performed, a sheet stacking unit to feed a sheet can be selected based on the number of holes that is acquired from specification information about the punch unit and the number of holes that is set by the user.

In a third exemplary embodiment, an example is described in which sheet processing is limited if a punch attribute of a pre-punched sheet does not coincide with a punch attribute of punching processing to be performed on a fed sheet.

The hardware configuration of the apparatus is similar to that in the first exemplary embodiment. Thus, detailed description thereof is omitted.

Figure 15:
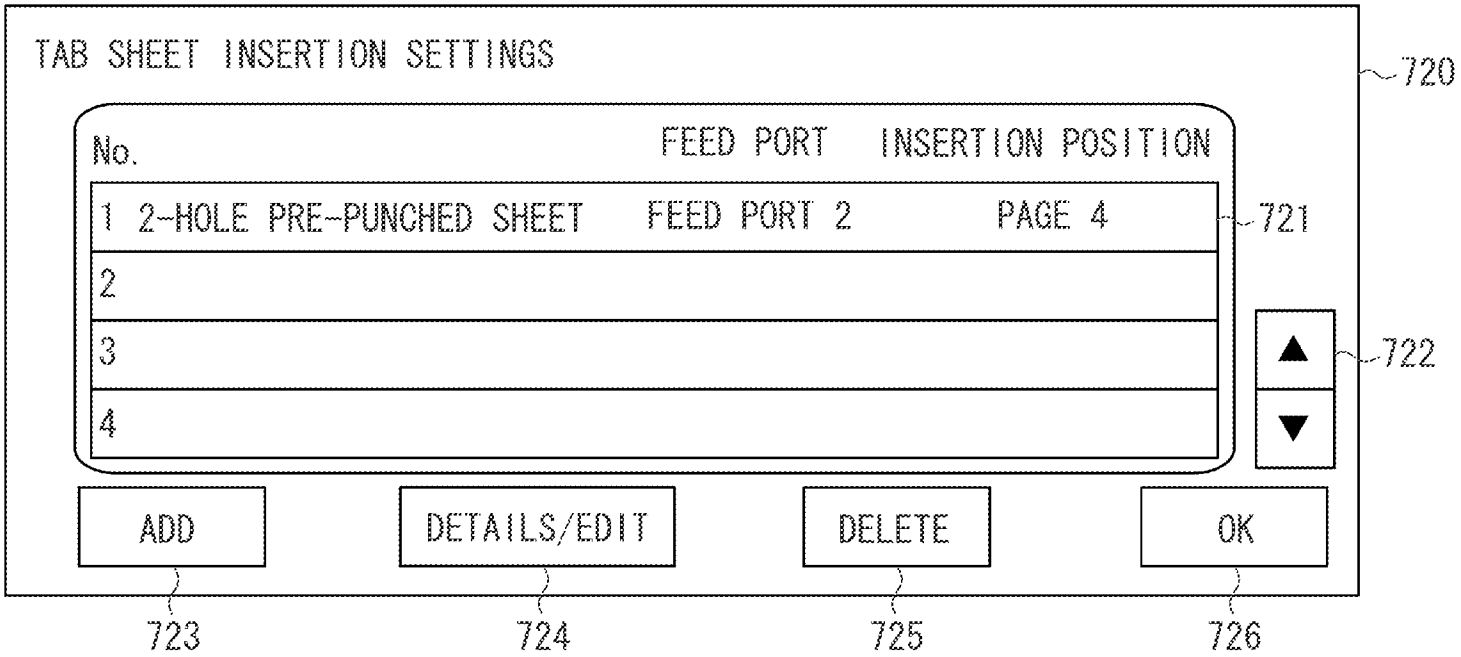
FIG. 15 illustrates an example of a UI screen displayed on an operation unit illustrated in FIG. 1.
Figure 16:
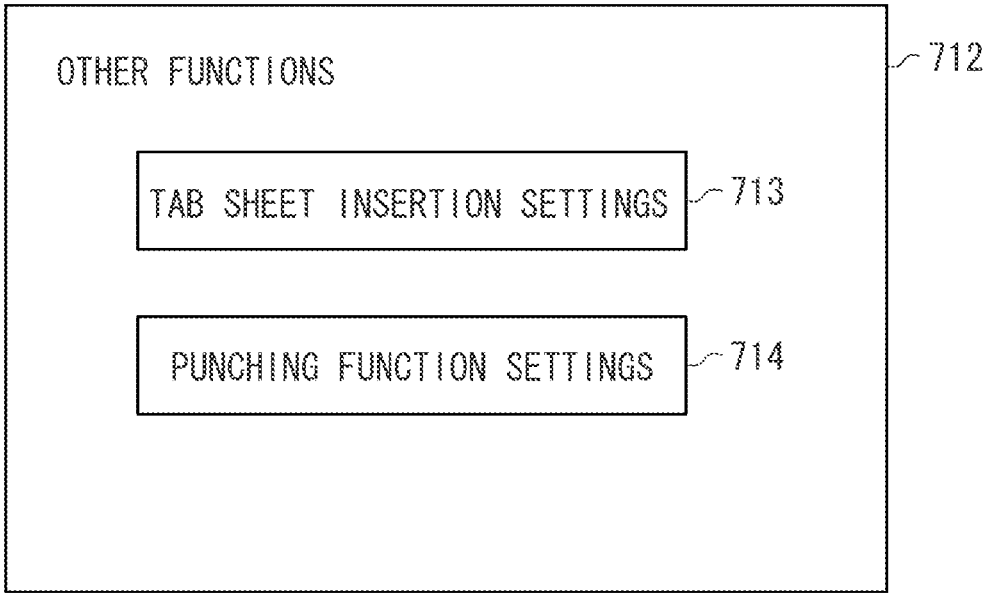
FIG. 16 illustrates an example of a UI screen displayed on the operation unit illustrated in FIG. 1.
Figure 17:
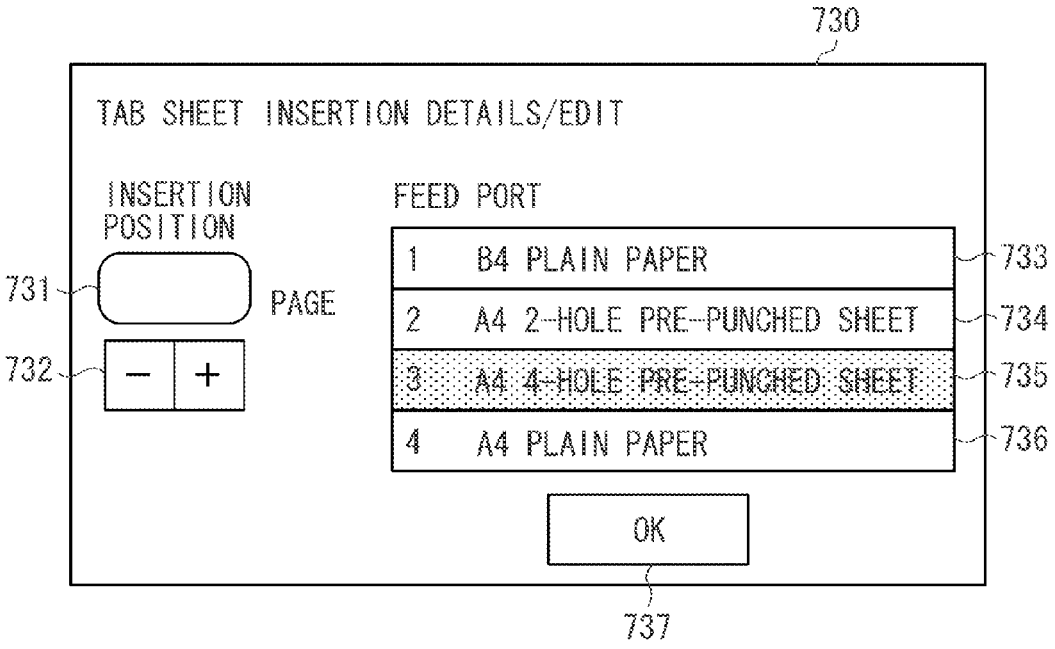
FIG. 17 illustrates an example of a UI screen displayed on the operation unit illustrated in FIG. 1.
Figure 18:
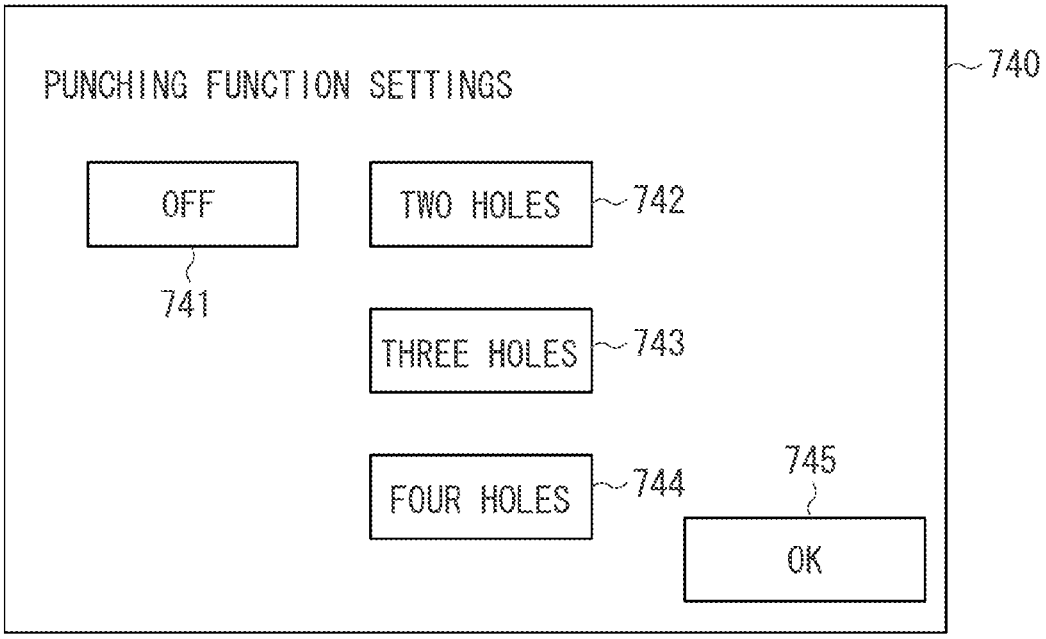
FIG. 18 illustrates an example of a UI screen displayed on the operation unit illustrated in FIG. 1.
Figure 19:
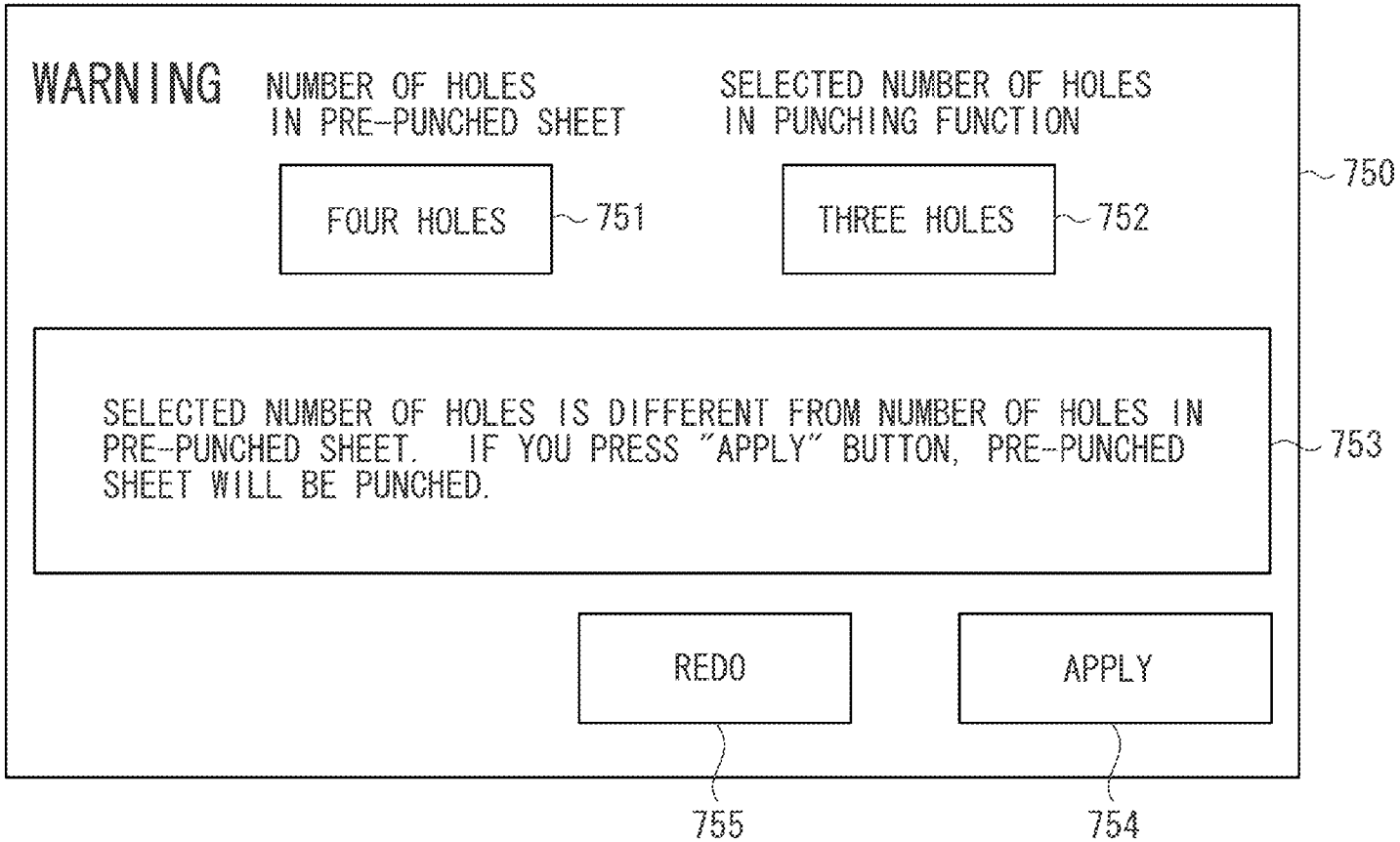
FIG. 19 illustrates an example of a UI screen displayed on the operation unit illustrated in FIG. 1.

In the present exemplary embodiment, a screen illustrated in FIG. 16 is displayed in place of the screen illustrated in FIG. 10. A screen illustrated in FIG. 15 is displayed in place of the screen illustrated in FIG. 11. A screen illustrated in FIG. 17 is displayed in place of the screen illustrated in FIG. 12. Further, screens illustrated in FIGS. 18 and 19 are displayed.

In the present exemplary embodiment, if the user presses the tab sheet insertion setting key 713 on the other functions screen 712 illustrated in FIG. 10, the LCD 600 displays the tab sheet insertion setting screen 720 illustrated in FIG. 15.

On the tab sheet insertion setting screen 720 illustrated in FIG. 15, a tab sheet insertion list 721 is a list of tab sheet insertion settings set by the user. A scroll key 722 is for scrolling the tab sheet insertion list 721 upward or downward. The tab sheet insertion setting screen 720 also displays a tab sheet insertion setting addition key 723, a tab sheet insertion setting details/edit key 724, and a tab sheet insertion setting deletion key 725.

When the tab sheet insertion setting addition key 723 is pressed, the LCD 600 displays a tab sheet insertion details/edit screen 730 illustrated in FIG. 17.

On the tab sheet insertion details/edit screen 730 illustrated in FIG. 17, when an insertion position page setting key 732 is pressed, the insertion position page number displayed on an insertion position display section 731 increases or decreases. On the tab sheet insertion details/edit screen 730, feed port selection keys 733 to 736 are for selecting a feed port as a conveyance source of a tab sheet to be inserted.

When an OK key 737 is pressed after inputting the insertion position and selecting the feed port, the tab sheet insertion details/edit screen 730 is closed to return to the tab sheet insertion setting screen 720, and the tab sheet insertion setting is added to the tab sheet insertion list 721.

On the tab sheet insertion setting screen 720 illustrated in FIG. 15, when the tab sheet insertion setting details/edit key 724 is pressed, the LCD 600 displays the tab sheet insertion details/edit screen 730 to display details of the tab sheet insertion setting selected in the tab sheet insertion list 721.

On the tab sheet insertion setting screen 720 illustrated in FIG. 15, when the tab sheet insertion setting deletion key 725 is pressed, the tab sheet insertion setting selected in the tab sheet insertion list 721 is deleted. At the press of an OK key 726, the tab sheet insertion setting is saved to the RAM 35, and the LCD 600 displays the other functions screen 712.

A method for setting a punching function will be described with reference to FIGS. 9, 16, and 18.

The UI screen illustrated in FIG. 9 is a copy setting screen displayed on the LCD 600.

On the copy setting screen 710 illustrated in FIG. 9, if the user presses the other functions key 711, the other functions screen 712 illustrated in FIG. 16 is displayed on the LCD 600. On the other functions screen 712, if the user presses a punching function setting key 714, the LCD 600 displays the punching function setting screen 740 illustrated in FIG. 18.

The punching function setting screen 740 illustrated in FIG. 18 displays a key 741 and selection keys 742, 743, and 744. The key 741 is for not executing the punching function. The selection keys 742, 743, and 744 are for selecting two holes, three holes, and four holes as the number of punch holes, respectively. If the user presses the key 741 for not executing the punching function or the selection key 742, 743, or 744 for selecting the number of punch holes, the pressed key is highlighted.

If the user presses the OK key 745, the punching function setting is saved in the RAM 35, and the LCD 600 displays the other functions screen 712.

Figure 20:
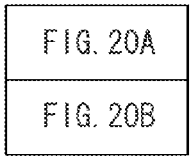
FIG. 20 (20A and 20B) is a flow chart illustrating a method for controlling a sheet processing apparatus.
Figure 20A:
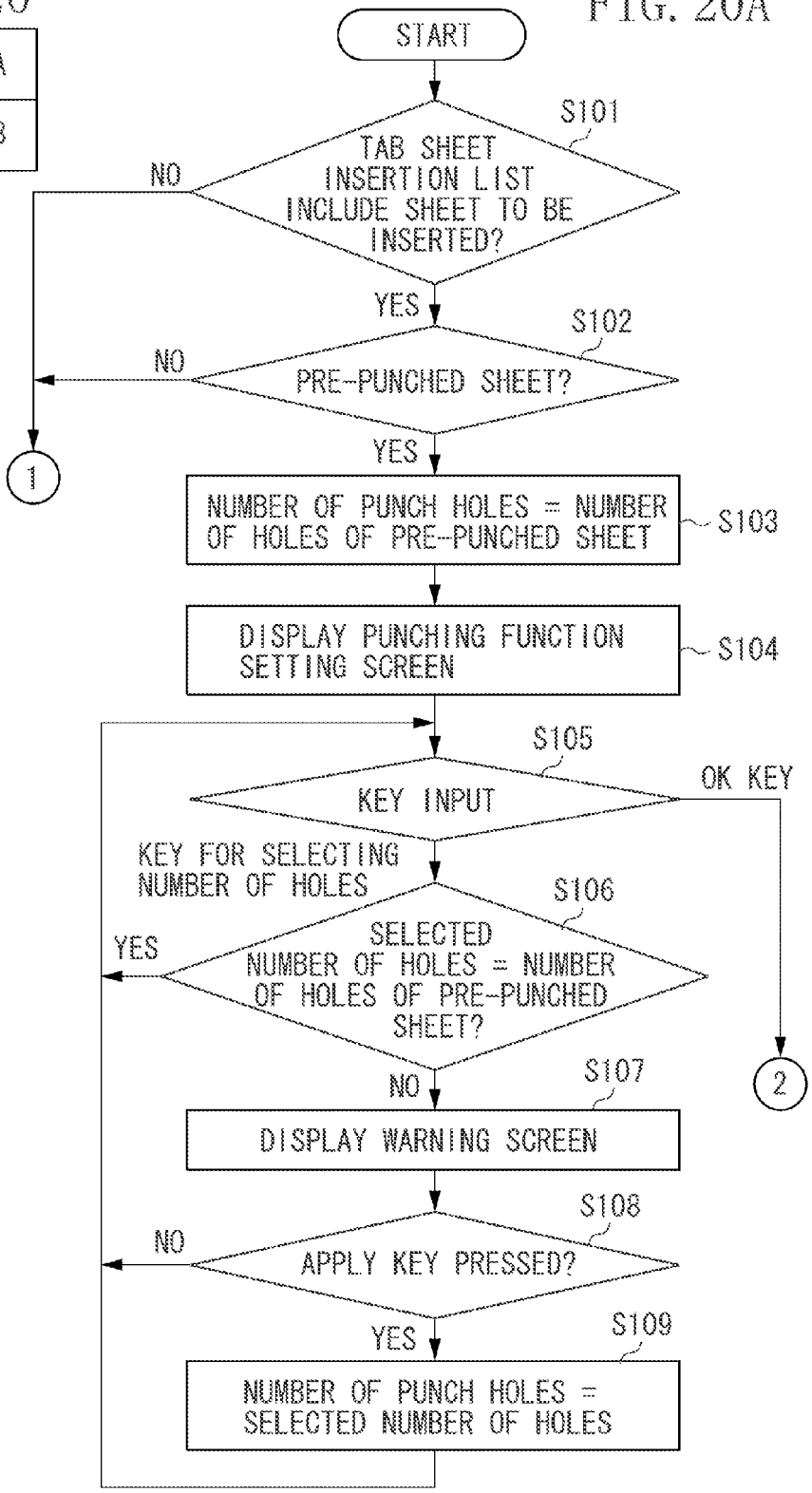
Figure 20B:
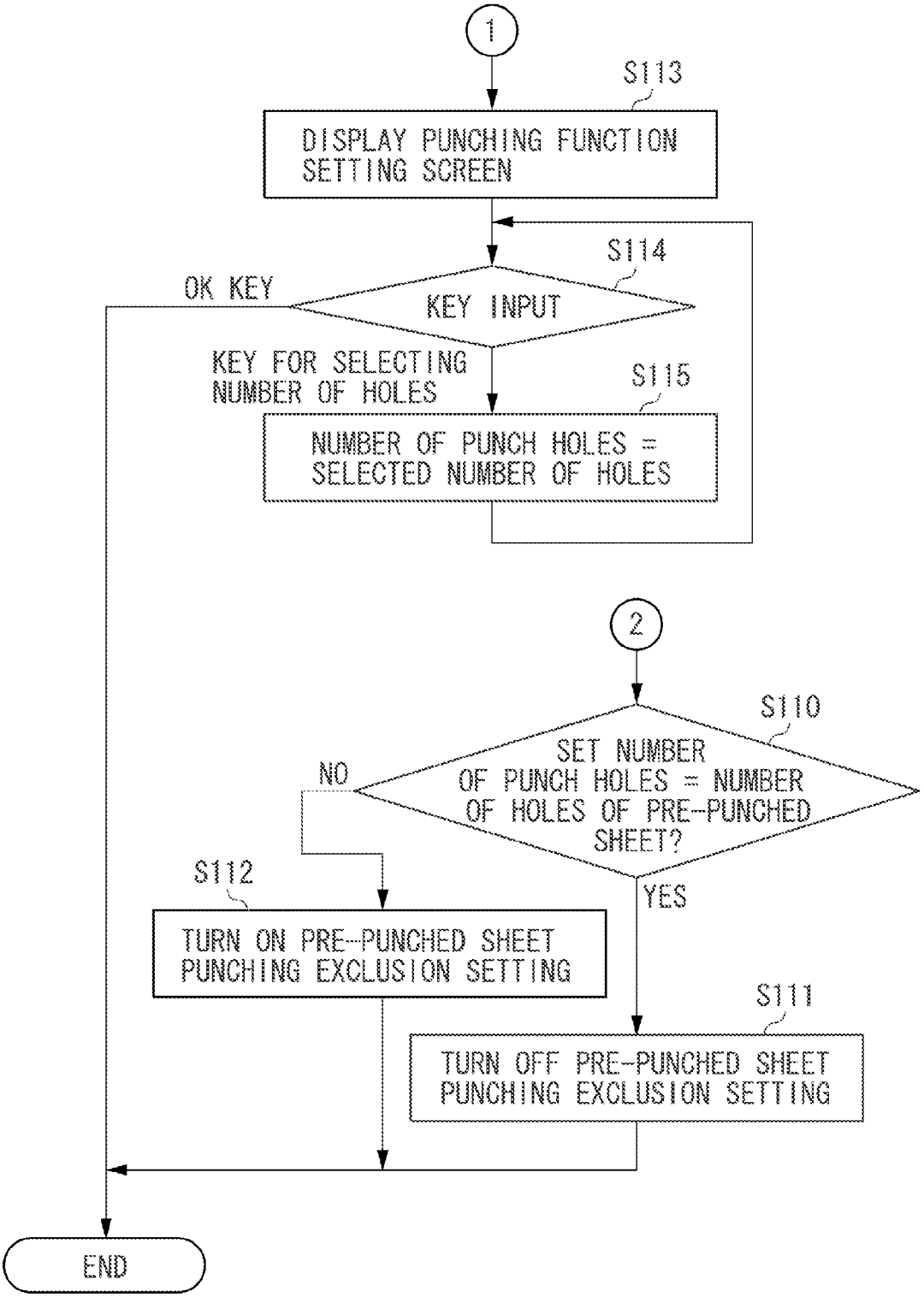

FIG. 20 (20A and 20B) is a flow chart illustrating a method for controlling a sheet processing apparatus according to the present exemplary embodiment. This is an example of sheet setting processing performed based on the punching function setting screen 740 at the press of the punching function setting key 714 illustrated in FIG. 16. The CPU 31 executes a control program stored in the ROM 36 or the like to realize each step.

An example of processing that uses a pre-punched sheet and performs punching processing on a fed sheet will be described, in which an attribute (punch attribute) of pre-punched holes of a pre-punched sheet and a punch attribute of the punching in a fed sheet are determined to limit pre-punched sheet insertion processing.

If the user presses the punching function setting key 714 on the other functions screen 712 displayed on the LCD 600 as illustrated in FIG. 16, in step S101, the CPU 31 determines whether a sheet to be inserted exists in the tab sheet insertion list 721. If the CPU 31 determines that a sheet to be inserted exists (YES in step S101), the processing proceeds to step S102. If the CPU 31 determines that a sheet to be inserted does not exist (NO in step S101), the processing proceeds to step S113.

In step S102, the CPU 31 determines whether the sheets listed in the tab sheet insertion list 721 include a pre-punched sheet. If the sheets listed in the tab sheet insertion list 721 include a pre-punched sheet (YES in step S102), the processing proceeds to step S103. If the sheets listed in the tab sheet insertion list 721 do not include a pre-punched sheet (NO in step S102), the processing proceeds to step S113.

In step S103, the CPU 31 sets the number of holes of the pre-punched sheet as the number of punch holes, and the processing proceeds to step S104.

In step S104, the CPU 31 displays the punching function setting screen 740 in the state in which the selection key 742, 743, or 744 for selecting the set number of punch holes that is set in step S103 is selected, and the processing proceeds to step S105.

In step S105, the CPU 31 waits for a user key input operation. If the CPU 31 determines that the user presses the OK key 737, the processing proceeds to step S110. If the CPU 31 determines that the user presses the selection key 742, 743, or 744 for selecting the number of punch holes or the key 741 for not executing the punching function, the processing proceeds to step S106.

In step S106, the CPU 31 compares the selected number of holes that is selected in step S105 to the number of holes of the pre-punched sheet. If the CPU 31 determines that the selected number of holes is different from the number of holes of the pre-punched sheet (NO in step S106), the processing proceeds to step S107. If the CPU 31 determines that the selected number of holes is the same as the number of holes of the pre-punched sheet (YES in step S106), the processing proceeds to step S105.

In step S107, the CPU 31 executes notification processing to display a warning screen 750 illustrated in FIG. 19 on the LCD 600, and the processing proceeds to step S108. In FIG. 19, a box 751 displays the number of holes of the pre-punched sheet, and a box 752 displays the selected number of punch holes that is selected in step S105. Further, a warning message 753 is a notification to the user.

In step S108, if the user presses an apply key 754 (YES in step S108), the processing proceeds to step S109. On the other hand, if the user presses a redo key 755 (NO in step S108), the processing proceeds to step S105, and the CPU 31 displays the punching function setting screen 740 on the LCD 600.

In step S109, the CPU 31 sets as the number of punch holes the selected number of holes that is selected in step S105. Then, the processing proceeds to step S105, and the CPU 31 displays the punching function setting screen 740 on the LCD 600.

In step S110, the CPU 31 compares the set number of punch holes to the number of holes of the pre-punched sheet. If the CPU 31 determines that the set number of punch holes is the same as the number of holes of the pre-punched sheet (YES in step S110), the processing proceeds to step S111. If the CPU 31 determines that the set number of punch holes is different from the number of holes of the pre-punched sheet (NO in step S110), the processing proceeds to step S112.

In step S111, the CPU 31 turns off a pre-punched sheet punching exclusion setting on the RAM 35, displays the other functions screen 712 on the LCD 600, and ends the processing. As used herein, the turning off refers to deactivation of the pre-punched sheet insertion setting.

In step S112, the CPU 31 turns on the pre-punched sheet punching exclusion setting on the RAM 35 and displays the other functions screen 712 on the LCD 600.

In step S113, the CPU 31 displays the punching function setting screen 740 in the state in which the selection key 742, 743, or 744 corresponding to the set number of punch holes or the key 741 for not executing the punching function is selected, and the processing proceeds to step S114.

In step S114, the CPU 31 waits for a user key input operation. If the user presses the OK key 737, the CPU 31 displays the other functions screen 712 on the LCD 600 and ends the processing. If the user presses the selection key 742, 743, or 744 for selecting the number of punch holes or the key 741 for not executing the punching function, the processing proceeds to step S115.

In step S115, the CPU 31 sets as the number of punch holes the selected number of holes that is selected in step S114. Then, the processing proceeds to step S114, and the CPU 31 displays the punching function setting screen 740 on the LCD 600.

As described above, in the case where insertion of a pre-punched sheet is set in the tab sheet insertion setting, the number of punch holes that is the same as the number of pre-punched holes of the pre-punched sheet is automatically selected in the punching function setting so that the optimum number of punch holes can be set without the selection by the user.

Further, if the user selects a different punch hole setting, the warning screen is displayed so that the user can recognize that the number of punch holes set in the selected setting is different from the number of pre-punched holes of the pre-punched sheet, and the user is guided not to select the number of punch holes.

While in the present exemplary embodiment, whether there is a difference between the pre-punched sheet and the punching function setting is determined based only on the number of punch holes to be punched by the punch unit 250, not only the number of punch holes but also the positions, sizes, or the like of holes may be compared as punch attributes.

In the third exemplary embodiment, the example of control in the punching function setting in the case where insertion of a pre-punched sheet is set in the tab sheet insertion setting will be described. A case where the tab sheet insertion setting is performed when the punching function is set will be described according to a fourth exemplary embodiment. Description of processing similar to that in the first exemplary embodiment is omitted.

Figure 21:
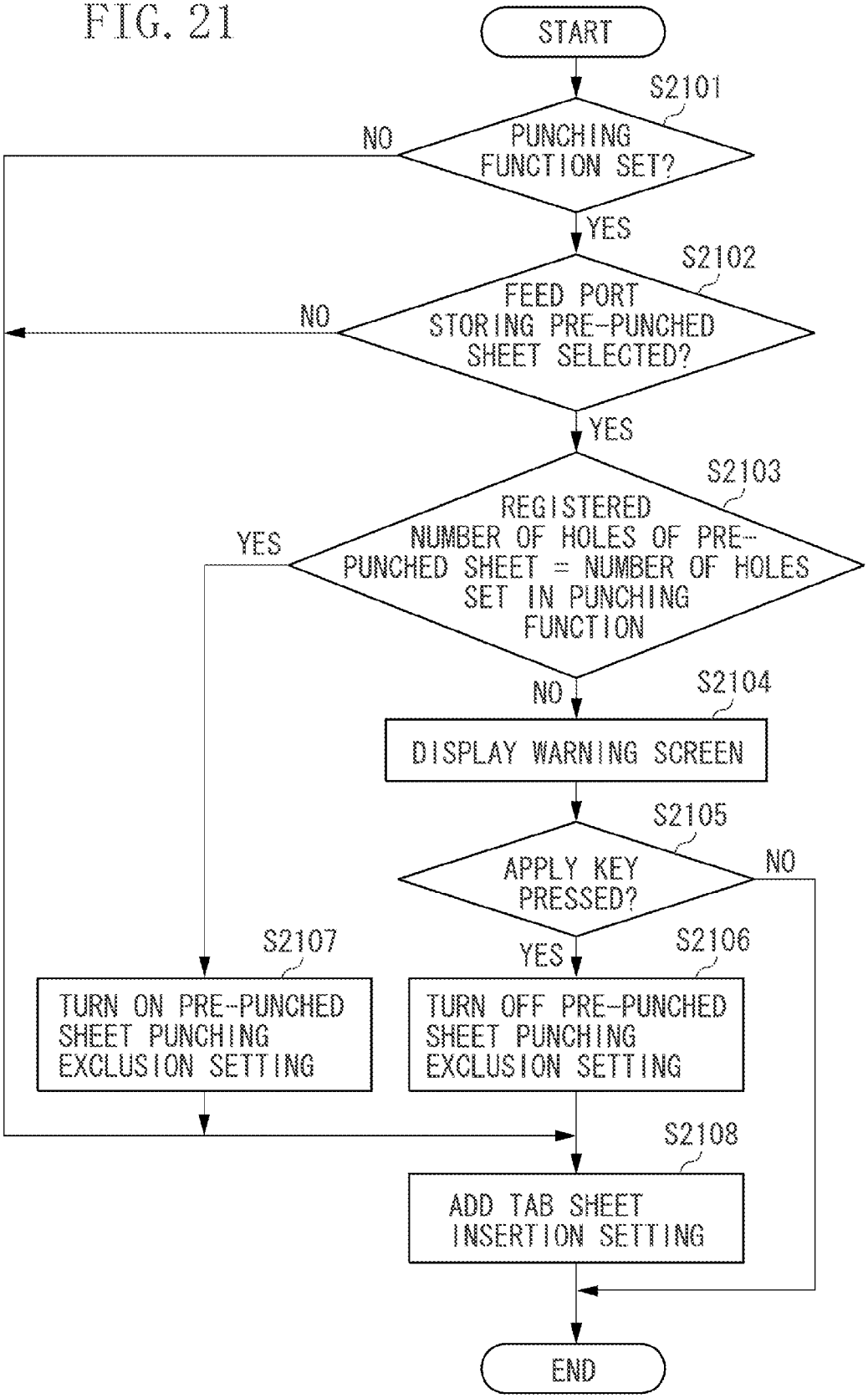
FIG. 21 is a flow chart illustrating a method for controlling a sheet processing apparatus.

FIG. 21 is a flow chart illustrating a method for controlling a sheet processing apparatus according to the present exemplary embodiment. This is an example of control on the tab sheet insertion details/edit screen 730 in tab sheet insertion setting. The CPU 31 executes a control program stored in the ROM 36 or the like to realize each step.

If the user presses the OK key 737 on the tab sheet insertion details/edit screen 730, in step S2101, the CPU 31 determines whether the punching function is set. If the punching function is set (YES in step S2101), the processing proceeds to step S2102. If the punching function is not set (NO in step S2101), the processing proceeds to step S2108.

In step S2102, the CPU 31 determines whether any one of the feed port selection keys 733 to 736 is selected. If the CPU 31 determines that a feed port that stores a pre-punched sheet is selected (YES in step S2102), the processing proceeds to step S2103. If the CPU 31 determines that a feed port that stores a pre-punched sheet is not selected (NO in step S2102), the processing proceeds to step S2108.

In step S2103, the CPU 31 determines whether the registered number of holes of the pre-punched sheet coincides with the number of holes that is set to the punching function. If the CPU 31 determines that the registered number of holes of the pre-punched sheet does not coincides with the number of holes that is set to the punching function (NO in step S2103), the processing proceeds to step S2104. If the CPU 31 determines that the registered number of holes of the pre-punched sheet corresponds to the number of holes that is set in the punching function (YES in step S2103), the processing proceeds to step S2107.

In step S204, the CPU 31 displays on the LCD 600 the warning screen 750 illustrated in FIG. 19, and the processing proceeds to step S2105.

In step S2105, if the CPU 31 determines that the user presses the apply key 754 (YES in step S2105), the processing proceeds to step S2106. If the user presses the redo key 755 (NO in step S2105), the CPU 31 displays the tab sheet insertion setting screen 720 on the LCD 600 and ends the processing.

In step S2106, the CPU 31 turns off the pre-punched sheet punching exclusion setting on the RAM 35, and the processing proceeds to step S2108.

In step S2107, the CPU 31 turns on the pre-punched sheet punching exclusion setting on the RAM 35, and the processing proceeds to step S2108.

In step S2108, the CPU 31 adds the tab sheet insertion setting to the tab sheet insertion list 721, displays the tab sheet insertion setting screen 720, and ends the processing.

As described above, in the case where the punching function setting is set, if the user selects a pre-punched sheet that is different from the punching function setting in the tab sheet insertion function setting, a warning screen is displayed. In this way, the user can recognize that the number of pre-punched holes of the selected pre-punched sheet is different from the number of punch holes set in the punching function setting, and the user is guided not to select the pre-punched sheet.

While in the present exemplary embodiment, whether there is a difference between the pre-punched sheet and the punching function setting is determined based only on the number of punch holes, not only the number of punch holes but also the positions, sizes, or the like of holes may be compared.

Further, while the tab sheet insertion is described, the present invention is also applicable to a case where a pre-punched sheet other than a tab sheet is to be inserted.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-213555 filed Oct. 11, 2013 and No. 2013-213556 filed Oct. 11, 2013, which are hereby incorporated by reference herein in their entirety.

What is claimed is:

1. A sheet processing apparatus comprising:

a puncher configured to punch holes in a first sheet conveyed from one of a plurality of sheet storing units;

a discharge roller configured to discharge the first sheet having the holes punched by the puncher and a second sheet conveyed from other of the plurality of sheet storing unit, the second sheet being a pre-punched sheet;

a processor; and a memory storing instructions which, when executed by the processor, cause the sheet processing apparatus to:

acquire a number of holes of the second sheet;

acquire a number of holes of the first sheet to be punched by the puncher;

determine whether the acquired number of holes of the second sheet coincides with the acquired number of holes of the first sheet to be punched; and display a predetermined warning in a case where it is determined that the acquired number of holes of the second sheet does not coincide with the acquired number of holes of the first sheet to be punched.

2. The sheet processing apparatus according to claim 1, wherein the predetermined warning is a message indicating that a position of a hole of the second sheet does not coincide with a position of a hole to be punched in the first sheet.

3. The sheet processing apparatus according to claim 1, wherein the warning is a graphic indicating that a position of a hole of the second sheet does not coincide with a position of a hole to be punched in the first sheet.

4. The sheet processing apparatus according to claim 1, wherein the pre-punched sheet is a tab sheet.

5. The sheet processing apparatus according to claim 1, wherein the processor does not cause the puncher to punch the holes in the first sheet in a case where it is determined that the acquired number of holes of the second sheet does not coincide with the acquired number of holes of the first sheet to be punched.

6. The sheet processing apparatus according to claim 1, wherein the processor selects one of the sheet storing units as a conveyance source of the first sheet based on the acquired number of holes of the second sheet and the acquired number of holes of the first sheet in a case where sheet processing using the second sheet is performed.

7. A method for controlling a sheet processing apparatus including a plurality of sheet storing units and a puncher configured to punch holes in a first sheet conveyed from one of the sheet storing units, the method comprising:

discharging the first sheet having the holes punched by the puncher and a second sheet conveyed from other of the plurality of sheet storing unit, the second sheet being a pre-punched sheet;

acquiring a number of holes of the second sheet;

acquiring a number of holes of the first sheet to be punched by the puncher;

determining whether the acquired number of holes of the second sheet coincides with the acquired number of holes of the first sheet to be punched; and displaying a predetermined warning in a case where it is determined that the acquired number of holes of the second sheet does not coincide with the acquired number of holes of the first sheet to be punched.

8. The sheet processing apparatus according to claim 1, wherein the processor deactivates the second sheet insertion setting in a case where it is determined that the acquired number of holes of the second sheet does not coincide with the acquired number of holes of the first sheet to be punched.

9. The sheet processing apparatus according to claim 1, wherein, in a case where the acquired number of holes of the second sheet does not coincide with the acquired number of holes of the first sheet, the first sheet is not conveyed from the one of the plurality of sheet storing units.

10. The sheet processing apparatus according to claim 1, wherein the processor selects a sheet storing unit from the sheet storing units as a conveyance source of the first sheet or the second sheet.

11. The sheet processing apparatus according to claim 1, wherein the processor sets a punch attribute of the second sheet.

12. The sheet processing apparatus according to claim 11, wherein the punch attribute includes the number, size, and position of the holes of the second sheet.

13. The sheet processing apparatus according to claim 1, wherein, in a case where a job to discharge the first sheet and the second sheet is specified, the processor determines whether the acquired number of holes of the second sheet coincides with the acquired number of holes of the first sheet to be punched.

14. An image forming apparatus comprising:

a first feeder configured to feed a first sheet;

a second feeder configured to feed a second sheet, the second sheet being a pre-punched sheet;

a printer configured to print an image on the first sheet fed by the first feeder;

a puncher configured to punch holes in the first sheet on which the image is printed by the printer;

a discharge roller configured to discharge the first sheet having the holes punched by the puncher and the second sheet fed by the second feeder;

a processor; and a memory storing instructions which, when executed by the processor, cause the sheet processing apparatus to:

acquire a number of holes of the second sheet to be fed by the second feeder;

acquire a number of holes of the first sheet to be punched by the puncher;

determine whether the acquired number of holes of the second sheet coincides with the acquired number of holes of the first sheet to be punched; and display a warning in a case where the acquired number of holes of the second sheet does not coincide with the acquired number of holes of the first sheet to be punched, wherein, in a case where the acquired number of holes of the second sheet coincides with the acquired number of holes of the first sheet to be punched, the first sheet and the second sheet are discharged by the discharged roller.

* * * * *